US007222847B2

(12) United States Patent
Yamamoto

(10) Patent No.: US 7,222,847 B2
(45) Date of Patent: May 29, 2007

(54) FEEDING APPARATUS AND RECORDING APPARATUS HAVING THE SAME

(75) Inventor: Kosuke Yamamoto, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 280 days.

(21) Appl. No.: 10/923,740

(22) Filed: Aug. 24, 2004

(65) Prior Publication Data

US 2005/0077674 A1 Apr. 14, 2005

(30) Foreign Application Priority Data

Aug. 29, 2003 (JP) ..... 2003-306413

(51) Int. Cl.
*B65H 1/14* (2006.01)

(52) U.S. Cl. ..... 271/153; 271/147; 271/127

(58) Field of Classification Search ..... 271/126, 271/127, 265.01, 272, 273, 147, 152–155
See application file for complete search history.

(56) References Cited

U.S. PATENT DOCUMENTS 6,209,861 B1 * 4/2001 Kakuta et al. ..... 271/3.02
6,349,931 B1 * 2/2002 Kuo et al. ..... 271/110
6,585,254 B2 * 7/2003 Hsieh ..... 271/127
6,817,611 B2 * 11/2004 DiRamio ..... 271/273
2003/0193673 A1 10/2003 Yamamoto
2003/0209850 A1 * 11/2003 Asao ..... 271/65
2004/0012143 A1 1/2004 Yamamoto

FOREIGN PATENT DOCUMENTS

JP 05310330 A * 11/1993
JP 3090161 7/2000

* cited by examiner

*Primary Examiner*—Patrick Mackey
*Assistant Examiner*—Jeremy R Severson
(74) *Attorney, Agent, or Firm*—Fitzpatrick, Cella, Harper & Scinto

(57) ABSTRACT

The feeding apparatus includes a pressure plate cam gear which contacts and separates a pressure plate with and from a feeding roller rubber in a forward rotation of a stepping motor, then interrupts the drive power transmission to the pressure plate, then transmits the driving power again to the pressure plate by a reverse rotation of the stepping motor to return the pressure plate to a separated state and terminates the drive power transmission to the pressure plate, a gear portion provided at an end of a feeding roller shaft for transmitting the driving power from the stepping motor to the feeding roller rubber, and a control circuit for reversing the stepping motor after a leading end of a recording medium is detected by a PE sensor lever.

7 Claims, 23 Drawing Sheets

FEEDING APPARATUS AND RECORDING APPARATUS HAVING THE SAME

BACKGROUND OF THE INVENTION

1. Field of the Invention

The present invention relates to a feeding apparatus for feeding a recording medium such as a sheet material, a film material or a cut paper sheet one by one, and a recording apparatus equipped with such feeding apparatus.

2. Related Background Art

As a recording apparatus for recording a character or an image on a recording medium such as a cut paper sheet, there have conventionally been known an ink jet recording apparatus, a thermal transfer recording apparatus, an electrophotographic recording apparatus, etc.

Among these, a smaller configuration of the entire recording apparatus and a lower production cost are requested for the ink jet recording apparatus and the thermal transfer recording apparatus as they are often used in personal applications.

FIG. 21 is an external perspective view of a prior ink jet recording apparatus. In FIG. 21, a recording medium 200 is set in an automatic sheet feeding apparatus (hereinafter represented as ASF) 201. The ASF 201 is provided with a cover 202 for a main body of a recording portion having an ink jet recording portion therein. The ASF 201 is provided with a discharge tray 203 for supporting a recording medium after recording.

FIG. 22 is a perspective view of the ASF only in FIG. 21, in the course of a feeding operation.

Referring to FIG. 22, The ASF 201 is provided with an ASF base 209 for setting the recording medium 200. The ASF base 209 supports a feeding roller shaft 203, on which provided is a feeding rubber 206. FIG. 23 is a cross-sectional view showing the feeding rubber 206. As shown in FIG. 23, the feeding rubber 206 has a D-shaped cross section, and it is moved, prior to a feeding operation, to a position where a straight portion of the D-shape is opposed to the recording medium thereby preventing a friction between the recording medium and the feeding rubber 206. The recording medium is set along a pressure plate 210, which is brought closer to the feeding rubber 206 only in a feeding operation and is contacted with the recording medium 200 by a power of an unillustrated compression spring provided behind the pressure plate 210. The feeding roller shaft 203 receives a driving power from an unillustrated motor through a gear train 207, and is rotated in a direction to convey the recording medium 200 from the ASF base toward an unillustrated recording portion. A sensor masking portion 204, integrally formed on the feeding roller shaft 203, rotates together with the feeding roller shaft 203 and masks or exposes a transmission photosensor 205 fixed on an unillustrated substrate. The pressure plate 210 is contacted with and separated from the feeding roller 206, in synchronization with one turn of the feeding roller shaft 203.

A configuration executing such elevation and lowering of the pressure plate in synchronization with a rotating operation of the feeding roller shaft is disclosed for example in Japanese Registered Patent No. 3090161.

In an initial operation state of the ASF 201, the feeding roller shaft 203 is in such a rotational position that the sensor masking portion 204 masks the transmission photosensor 205. In such state the pressure plate 210 is separated from the feeding rubber 206. In case it is in a non-masking position, an initializing operation is executed by an initialization signal from the main body of the ink jet recording apparatus. In case it is in a masking position, after the entry of a recording signal, the feeding roller shaft 203 starts rotation and the pressure plate 210 approaches the feeding rubber 206, whereby the feeding rubber 206 comes into contact with the recording medium 200 thereby executing a feeding thereof. The recording medium 200 thus fed is separated into a sheet in a separating portion 208 and conveyed to the recording portion.

However, the prior recording apparatus described above has been associated with following drawbacks.

Firstly, in the prior recording apparatus, it is necessary to establish an initial position for the feeding operation, in order to prevent a frictional contact between the recording medium and the feeding roller rubber, and a position sensor is provided for this purpose. Therefore the prior recording apparatus requires a complex electrical structure with an increased production cost. Also since a drive control is executed for stopping a motor in response to a detection signal from the sensor, it is necessary to secure a precision in the stopping position of the motor. Therefore, a highly precise motor is required, leading to an increase in the production cost.

By forming the feeding roller rubber in a circular shape instead of the D-shape, it is no longer necessary to initialize the rotational position of the feeding roller rubber, but the position of the pressure plate needs to be initialized. In the prior configuration, a sensor is still required to initialize the pressure plate, thereby elevating the production cost as in the above-described configuration.

Secondly, in case the distance from the feeding roller rubber to the recording portion is made long, the feeding roller rubber is required to have a circumferential length at least equal to the feeding distance to the recording portion, so that it has to have a large diameter, thus increasing the dimension of the entire recording apparatus.

Particularly in an ASF of so-called cassette feeding type in which the recording media are set horizontally, instead of the above-described ASF which is provided in the conventional recording apparatus and in which the recording media are placed on a pressure plate in a state inclined from the horizontal direction, the diameter of the feeding roller directly influences the height of the entire recording apparatus. Therefore, such ASF is difficult to employ in realizing a recording apparatus of a reduced height, thus resulting in a large installation space.

Also, together with an increase in the size of the entire recording apparatus, an external casing, such as a cover, for the entire apparatus also becomes larger, thus resulting in an increase in the cost of the material for forming the external casing etc. and elevating the production cost.

Particularly in case of employing a feeding roller rubber of a D-shaped cross section for preventing frictional contact between the recording medium and the feeding roller rubber as in the prior recording apparatus described above, the circumferential length of the arched portion of the feeding roller rubber, other than the straight portion thereof, has to be made longer than the feeding distance to the recording portion. Therefore, an even larger diameter is required than in the feeding roller rubber of the circular shape, thus being difficult to use in realizing a recording apparatus of a reduced height.

Thirdly, the prior recording apparatus utilizes the biasing force of a compression coil spring provided at the rear side of the pressure plate, as pressurizing means for pressing the pressure plate to the feeding roller rubber. For this reason, a medium stacking portion for stacking the recording media becomes thicker by the length of such compression coil spring, thereby leading to an increase in the dimension of the entire apparatus. This drawback becomes more conspicuous, as in the case of the roller diameter mentioned above, in so-called cassette feeding in which the recording media are stacked horizontally.

SUMMARY OF THE INVENTION

In consideration of the foregoing, an object of the present invention is to provide a feeding apparatus, capable of reducing the dimension of the entire apparatus and the production cost thereof, and a recording apparatus utilizing the same.

The aforementioned object can be attained, according to the present invention, by a feeding apparatus including a feeding roller for feeding a recording medium, a pressure plate provided movably between a contact position pressed to the feeding roller and a separated position separated from the feeding roller, pressure plate pressing means which provides the pressure plate with a pressing load for contacting the pressure plate with the feeding roller, and a motor for generating a driving power for moving the pressure plate to the contact position and to the separated position and a driving power for rotating the feeding roller. The feeding apparatus of the present invention also includes first drive transmission means which rotates the motor in a forward direction to contact and separate the pressure plate with and from the feeding roller, then shifts the driving power to the pressure plate to a non-transmission state, rotates the motor in a reverse direction to again transmit the driving power to the pressure plate thereby returning the pressure plate to an initial separated state prior to the rotation in the forward direction and shifts the driving power to the pressure plate to a non-transmission state, and second drive transmission means which transmits the driving power from the motor to the feeding roller. Further, the feeding apparatus of the present invention includes medium separation means which is provided in a downstream side of a contact position between the pressure plate and the feeding roller in a conveying direction of the recording medium and which separates the recording media one by one, conveying means which is provided in a downstream side of the medium separation means, for conveying the recording medium, and control means which includes detection means for detecting arrival of a leading end of the recording medium at the conveying means and which reverses the motor after the detection of the leading end of the recording medium by the detection means.

The feeding apparatus of the present invention having the aforementioned configuration allows to dispense with phase detection means for detecting a rotational phase of the feeding roller and is capable of securely controlling the drive of the feeding roller.

Also the second drive transmission means provided in the feeding apparatus of the present invention transmits a driving power from the motor to the feeding roller through the first drive transmission means, and the feeding roller is rotated and stopped in synchronization with a transmission state and a non-transmission state of the driving power to the pressure plate. The feeding roller can therefore be rotated only during a period necessary for feeding. Consequently it is possible to securely control the rotational phase of the feeding roller without employing phase detection means, even in case the feeding roller has a non-circular cross-sectional shape, such as a D-shape.

The feeding apparatus of the present invention further includes a transfer roller positioned at a downstream side of the medium separation means and at an upstream side of the conveying means and serving to convey the recording medium, a pinch roller pressed to the transfer roller, and third drive transmission means for transmitting a rotary driving power from the motor to the transfer roller. The recording medium, fed by the feeding roller, can thus be transferred to the conveying means by means of the transfer roller and the pinch roller.

The third drive transmission means provided in the feeding apparatus of the present invention rotates the transfer roller in a direction for transferring the recording medium toward the conveying means, regardless whether the motor is rotated in the forward direction or in the reverse direction. Thus, even when the motor is reversed for transmitting the driving power so as to return the pressure plate to the separated position (initial position), the transfer roller does not rotate in the reverse direction but advances the recording medium in the feeding direction.

Also the third drive transmission means provided in the feeding apparatus of the present invention transmits the driving power from the motor to the transfer roller in a forward rotation state of the motor, and attains a non-transmission state of interrupting the transmission of the driving power in a reverse rotation state of the motor. In this manner, the transfer roller can be rotated by the conveying means when the motor is rotated in the reverse direction.

The feeding apparatus of the present invention further includes contact/separation means which contacts the transfer roller and the pinch roller when the motor is rotated in the forward direction and separates the transfer roller and the pinch roller when the motor is rotated in the reverse direction. Thus, the transfer roller and the recording medium can be maintained in a non-contact state after the leading end of the recording medium reaches the conveying means.

Also the pressure plate pressing means provided in the feeding apparatus of the present invention includes a spring for generating a contact load, and direction converting means which changes a direction of load substantially perpendicularly from a biasing direction of the spring to contact direction of the pressure plate to the feeding roller. Therefore, a length of the spring, in a direction of elastic deformation thereof, requires a smaller space in the stacking direction of the recording media (a direction perpendicular to the principal plane of the recording medium), thereby allowing to reduce the dimension of the feeding apparatus in the direction parallel to the stacking direction of the recording media and to reduce the dimension of the recording apparatus.

Also the pressure plate pressing means provided in the feeding apparatus of the present invention includes a first movable plate for moving the pressure plate, and a second movable plate for moving the first movable plate. The first and second movable plates are positioned parallel to the pressure plate when it is moved to the separated position. Therefore, the first and second movable plates for moving the pressure plate require a smaller space in the stacking direction of the recording media, thereby allowing to reduce the dimension of the feeding apparatus in the direction parallel to the stacking direction of the recording media and to reduce the dimension of the recording apparatus.

Further, the recording apparatus of the present invention includes recording means which executes a recording on the recording medium fed by the feeding apparatus of the present invention.

As explained in the foregoing, the feeding apparatus of the present invention includes a feeding roller for feeding a recording medium, a pressure plate provided movably between a contact position pressed to the feeding roller and a separated position separated from the feeding roller, pressure plate pressing means which provides the pressure plate with a pressing load for contacting the pressure plate with the feeding roller, a motor for generating a driving power for moving the pressure plate to the contact position and to the separated position and a driving power for rotating the feeding roller, first drive transmission means which rotates the motor in a forward direction to contact and separate the pressure plate with and from the feeding roller, then shifts the driving power to the pressure plate to a non-transmission state, rotates the motor in a reverse direction to again transmit the driving power to the pressure plate thereby returning the pressure plate to an initial separated state prior to the rotation in the forward direction and shifts the driving power to the pressure plate to a non-transmission state, second drive transmission means which transmits the driving power from the motor to the feeding roller, medium separation means which is provided in a downstream side of a contact position between the pressure plate and the feeding roller in a conveying direction of the recording medium and which separates the recording media one by one, conveying means which is provided in a downstream side of the medium separation means, for conveying the recording medium, and control means which includes detection means for detecting arrival of a leading end of the recording medium at the conveying means and which reverses the motor after the detection of the leading end of the recording medium by the detection means, and can thus dispense with a position sensor required for detecting an initial position of the pressure roller and a high-precision motor and can achieve an automatic initialization of the pressure plate by merely repeating the forward and reverse drives of the motor, to enable a next feeding operation, thereby realizing a reduction in the production cost.

Also the second drive transmission means provided in the feeding apparatus of the present invention transmits a driving power from the motor to the feeding roller through the first drive transmission means, and rotates and stops the feeding roller in synchronization with a transmission state and a non-transmission state of the driving power to the pressure plate, thereby rotating the feeding roller only during a period necessary for feeding. Therefore the feeding apparatus of the present invention can dispense with a position sensor for detecting the initial position of the pressure plate and the feeding roller and a high-precision motor and can achieve an automatic initialization of the pressure plate and the feeding roller by merely repeating the forward and reverse drives of the motor, to enable a next feeding operation, thereby realizing a reduction in the production cost.

The feeding apparatus of the present invention also includes a transfer roller positioned at a downstream side of the medium separation means and at an upstream side of the conveying means and serving to convey the recording medium, a pinch roller pressed to the transfer roller, and third drive transmission means for transmitting a rotary driving power from the motor to the transfer roller, and can thus set a feeding amount by the feeding roller at a feeding distance for the recording medium to reach the transfer roller, thereby allowing to reduce the diameter of the feeding roller and realizing reductions in the dimension and the production cost of the feeding apparatus.

The third drive transmission means provided in the feeding apparatus of the present invention rotates the transfer roller in a direction for transferring the recording medium toward the conveying means, regardless whether the motor is rotated in the forward direction or in the reverse direction, whereby, even when the motor is reversed for transmitting the driving power so as to return the pressure plate to the separated position, the transfer roller does not rotate in the reverse direction but advances the recording medium in the feeding direction. Therefore, in the reverse rotation state of the transfer roller, the recording medium is prevented from being pulled to the upstream side and being rubbed, whereby a recording apparatus of an excellent recording quality can be realized without a fluctuation in a recording start position or a damage of the recording medium.

Also the third drive transmission means provided in the feeding apparatus of the present invention transmits the driving power from the motor to the transfer roller in a forward rotation state of the motor, and attains a non-transmission state of interrupting the transmission of the driving power in a reverse rotation state of the motor, thereby rotating the transfer roller by the conveying operation of the conveying means when the motor is rotated in the reverse direction, whereby a recording apparatus of an excellent recording quality can be realized without a fluctuation in a recording start position or a damage of the recording medium.

The feeding apparatus of the present invention further includes contact/separation means which contacts the transfer roller and the pinch roller when the motor is rotated in the forward direction and separates the transfer roller and the pinch roller when the motor is rotated in the reverse direction, thereby maintaining the transfer roller and the recording medium in a non-contact state after the leading end of the recording medium reaches the conveying means, and preventing the conveying means from a load in an intermittent conveying the conveying means. Thus a recording apparatus of an excellent recording quality can be realized without white streaks or black streaks generated by a low feeding precision.

Also the pressure plate pressing means provided in the feeding apparatus of the present invention includes a spring for generating a contact load, and direction converting means which changes a direction of load substantially perpendicularly from a biasing direction of the spring to a contact direction of the pressure plate to the feeding roller, thereby allowing to reduce the dimension of the feeding apparatus in the direction parallel to the stacking direction of the recording media and to reduce the dimension of the recording apparatus.

Also the pressure plate pressing means provided in the feeding apparatus of the present invention includes a first movable plate for moving the pressure plate, and a second movable plate for moving the first movable plate. The first and second movable plates are positioned parallel to the pressure plate when it is moved to the separated position, thereby allowing to reduce the dimension of the feeding apparatus in the direction parallel to the stacking direction of the recording media and to reduce the dimension of the recording apparatus.

DETAILED DESCRIPTION OF THE PREFERRED EMBODIMENTS

In the following, the present invention will be explained by specific embodiments thereof, with reference to the accompanying drawings.

First Embodiment

Figure 1:
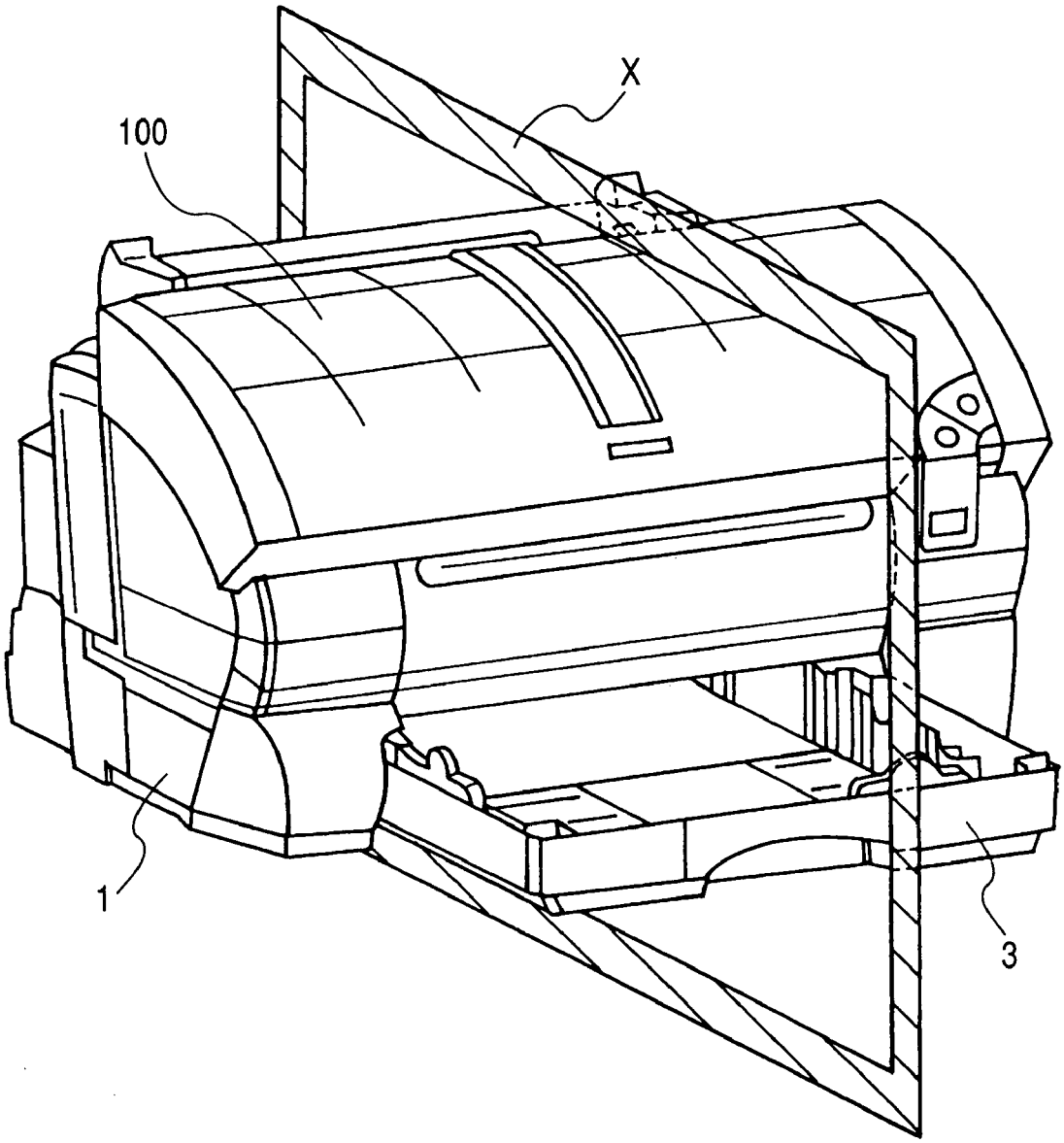
FIG. 1 is a perspective view showing a recording apparatus in a first embodiment of the present invention.

FIG. 1 is a perspective view showing a first embodiment of the present invention. As shown in FIG. 1, a recording apparatus of the present embodiment is provided with a cassette feeding unit 1 for feeding a recording medium, and a main body 100 of the recording apparatus for recording a character, an image etc. on the recording medium fed by the cassette feeding unit 1.

Figure 2:
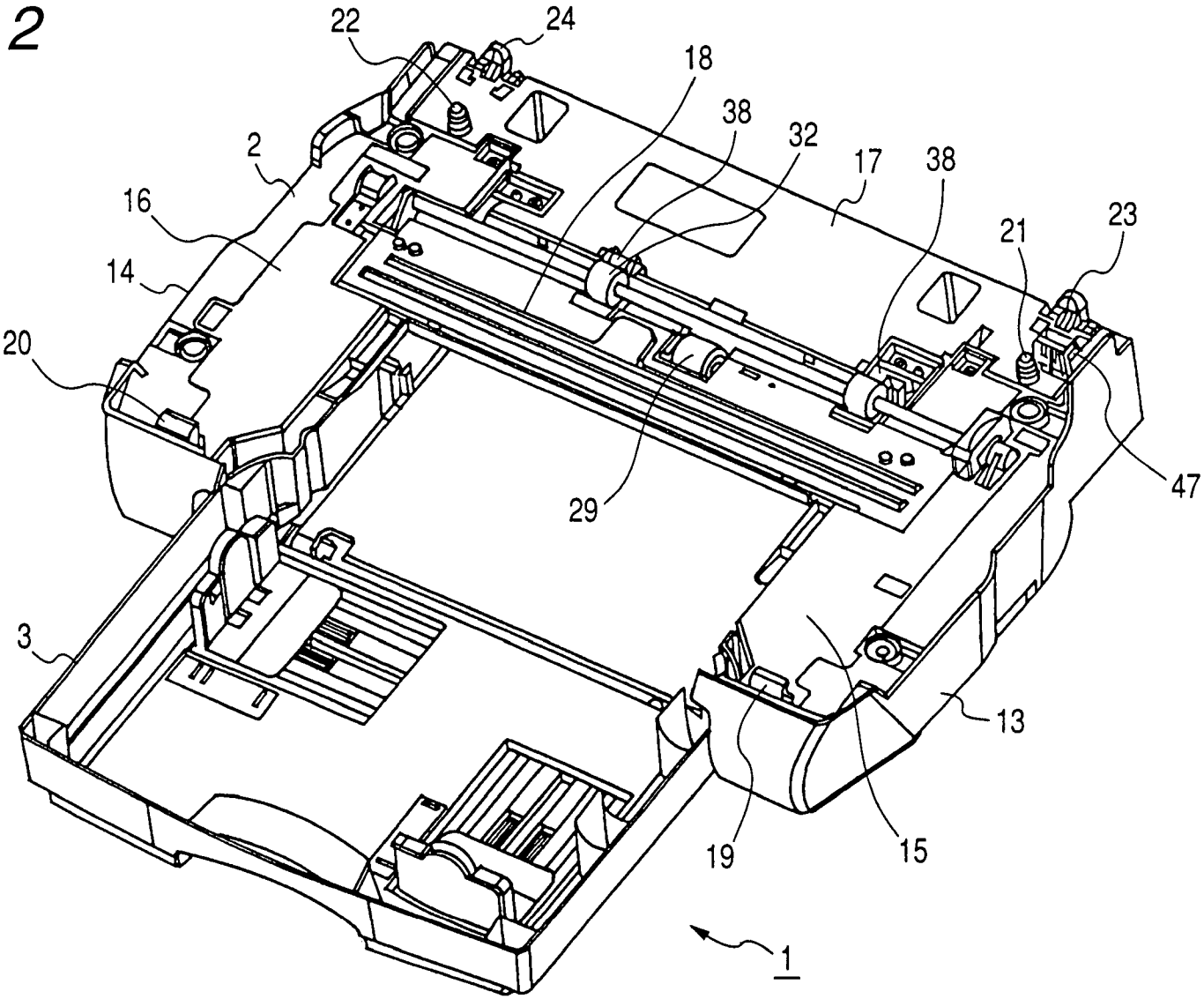
FIG. 2 is a perspective view showing a cassette feeding unit.

The cassette feeding unit 1, when the main body 100 of the recording apparatus is mounted by positioning thereon as shown in FIGS. 1 and 2, can feed the recording medium to the main body 100 for a recording therein.

As shown in FIG. 2, the cassette feeding unit 1 is provided with a unit main body portion 2 for feeding the recording medium, and a feeding cassette 3 provided detachably on the unit main body portion 2 and containing plural recording media.

Figure 3:
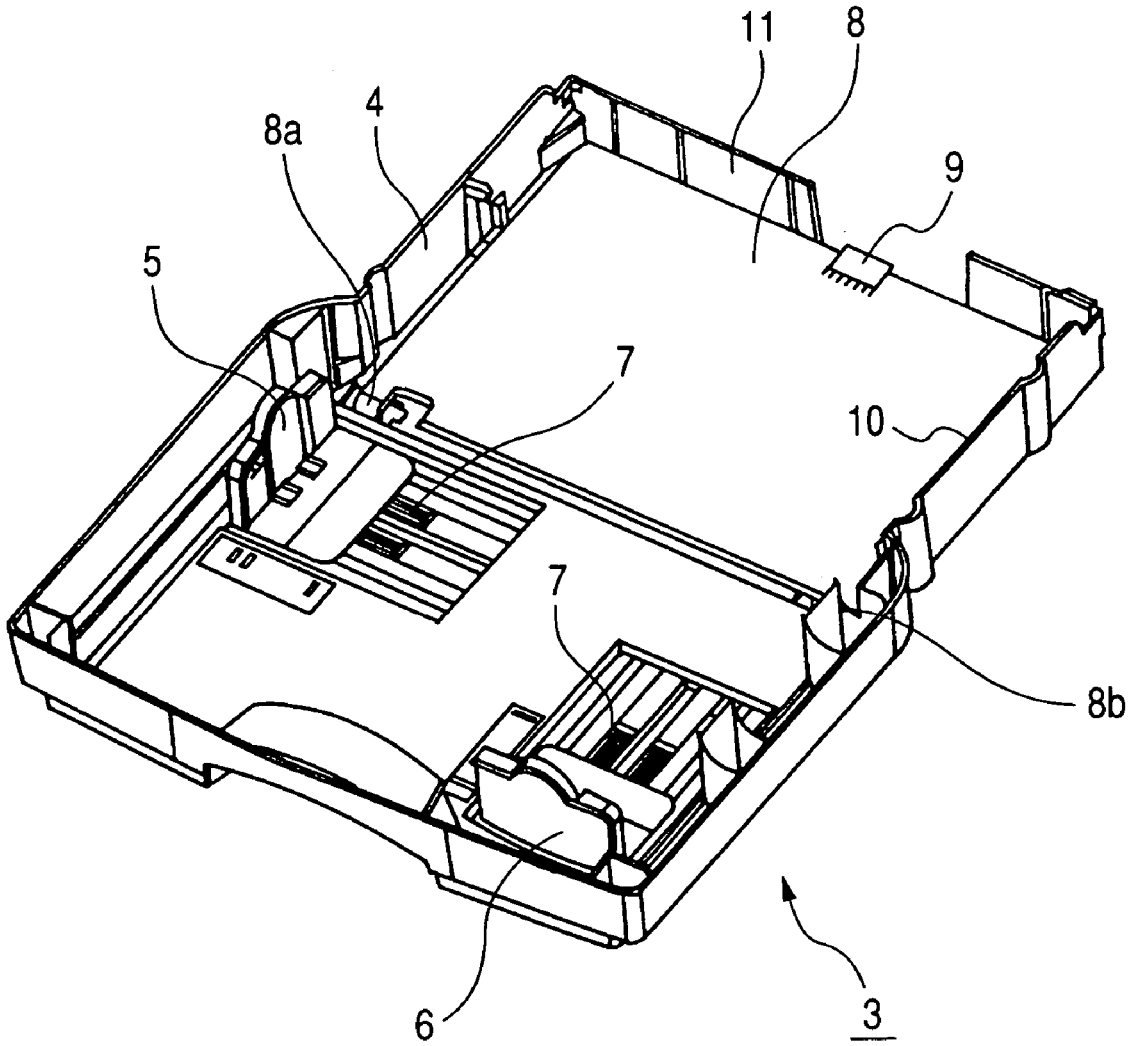
FIG. 3 is a perspective view showing a feeding cassette.

FIG. 3 is a perspective view showing the entire feeding cassette 3, which will be explained with reference to FIG. 3.

As shown in FIG. 3, the feeding cassette 3 has a cassette tray 4 for stacking plural recording media (not shown), capable of setting recording media of various sizes from a B5 size to an A4 size and a LTR (letter) size. Positioning of the recording medium is achieved by causing lateral ends of the recording medium to impinge respectively on reference lateral walls 10, 11 in the cassette tray 4, and by moving a side guide 5 and an end guide 6 so as to respectively abut on the external periphery of the recording medium. Such side guide 5 and end guide 6 are fixed by a ratchet 7 to the cassette tray 4.

On a bottom face of the cassette tray 4, a pressure plate 8 is rotatably provided. The pressure plate 8 is rendered rotatable, about a rotary center provided at an end and formed by rotary supporting portions 8*a*, 8*b* on a same axis, between a contact position contacted with a feeding roller rubber 29 to be explained later and a separated position separated from the feeding roller rubber 29.

On the pressure plate 8, a separating sheet 9 is fixed for example with a both-side adhesive tape. The separating sheet 9 is formed for example by a cork material and provides a frictional force to a recording medium positioned closest to bottom side of the cassette tray 4, thereby preventing so-called superposed feeding in which plural recording media are erroneously advanced. After plural recording media are stacked, the feeding cassette 3 is inserted and mounted in a main body portion 2 of the feeding unit to be explained later.

As shown in FIG. 2, the cassette feeding unit 1 has a right outer casing panel 13 and a left outer casing panel 14 and has an external shape matching that of the main body 100 of the recording apparatus to be explained later. The cassette feeding unit 1 also has a right-side cover 15, a left-side cover 16 and a separation base 17, which are so provided as to cover mechanical components to be explained later and are respectively provided with positioning surfaces for positioning the feeding cassette 3 relative to the unit main body portion 2. Also in a position adjacent to the separation base 17, there is provided an upper stay 18 formed by a metal plate and constituting a structural member for maintaining the mechanical strength of the entire cassette feeding unit 1. The right-side cover 15 and the left-side cover 16 are respectively provided with hooks 19, 20 for engaging with the main body 100 of the recording apparatus, whereby the main body 100 mounted on the cassette feeding unit 1 is fixed thereto.

On the separation base 17, there stand positioning pins 21, 22 by which the main body 100 of the recording apparatus is positioned relative to the cassette feeding unit 1, when the main body 100 of the recording apparatus is placed and mounted thereon. Also on the separation base 17, there are provided movable hooks 23, 24 which are biased in the illustrated positions by springs (not shown) and are rotated to engage with the main body 100 of the recording apparatus when it is placed. A rear button (not shown), when pressed in, rotates and unlocks the movable hooks 23, 24 against the elastic force of the springs, whereupon the main body 100 of the recording apparatus can be lifted and separated from the cassette feeding unit 1.

The separation base 17 is provided with a female connector 47, which engages and is connected with a male connector on a bottom face of the main body 100 of the recording apparatus when it is placed, whereby a power supply and a motor drive signal to be explained later are entered from the main body 100 of the recording apparatus to a circuit board (not shown).

Figure 4:
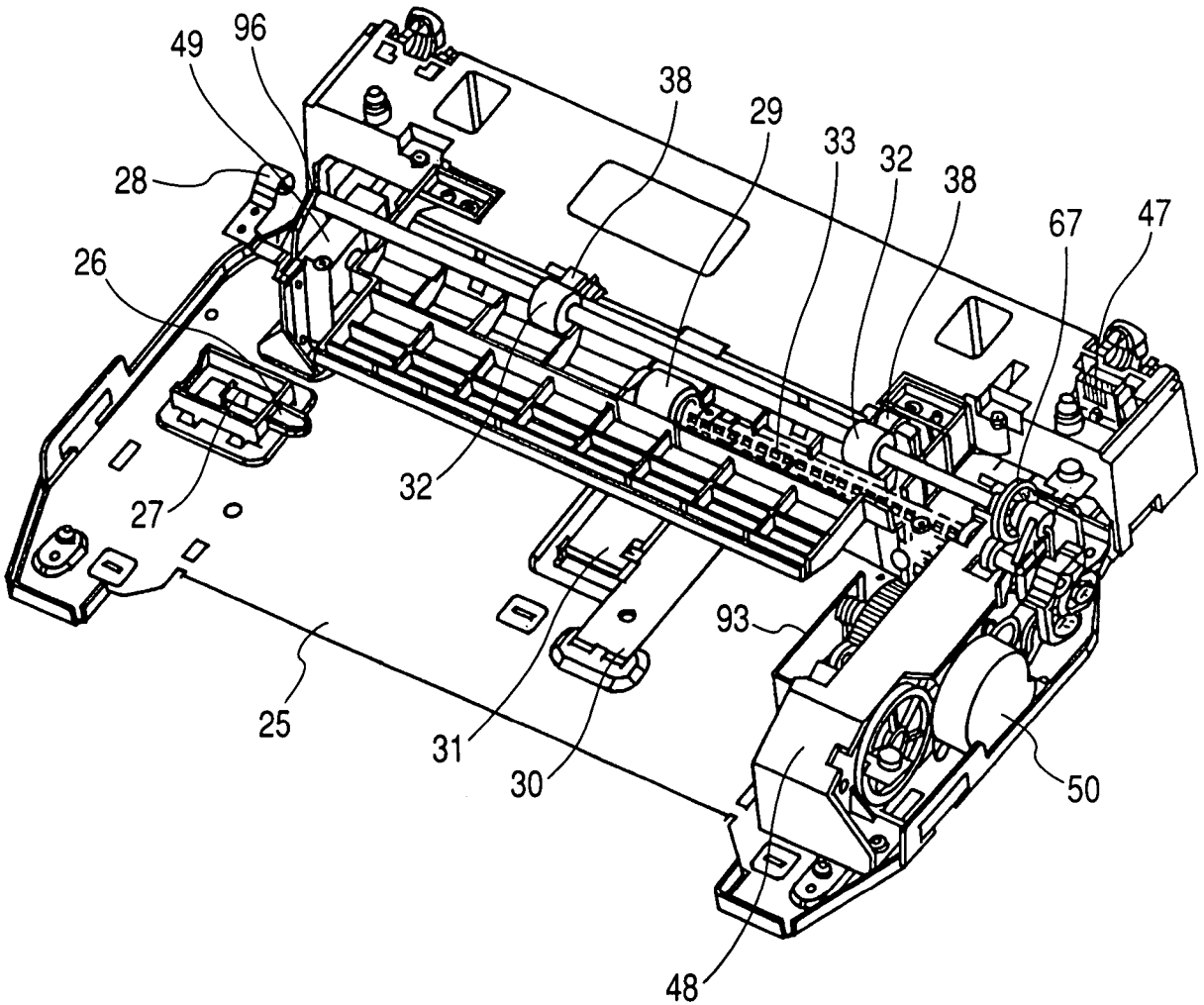
FIG. 4 is a perspective view showing a main body of the unit.

FIG. 4 is a perspective view of the unit main body portion 2 only, from which the right outer casing panel 13, the left outer casing panel 14, the right-side cover 15 and the left-side cover 16 are removed for the purpose of clarity.

As shown in FIG. 4, the unit main body portion 2 is provided with a metal base plate 25, on which the right-side cover 15, the left-side cover 16 and the separation base 17 are fixed with screws. The base plate 25 is provided with a cassette pressing pin 26 for pressing, by a biasing force of a compression spring 27, to a reference plane (not shown) of the right-side cover 15. The feeding cassette 3, being pressed by the cassette pressing pin 26, is positioned in a lateral direction (transversal direction of the recording medium) with respect to the unit main body portion 2. The cassette tray 24 is also provided, on a left lateral face thereof, with a recess (not shown) for accepting an end of the cassette pressing pin 26, whereby a positioning is achieved also in the longitudinal direction (lengthwise direction of the recording medium).

On the base plate 25, a grounding spring 28, to be contacted with a chassis portion to be explained later of the main body 100 of the recording apparatus, is fixed on the left-side cover 16 which is omitted in the drawing. A feeding roller rubber (feeding roller) 29 is pressed into a part of the axial direction of a feeding roller shaft 33. A transfer roller 32 is positioned at a downstream side of the feeding roller rubber 29 in a feeding direction of the recording medium 51, and is formed by two rubber roller portions integrally fixed on a metal rotary shaft. Pinch rollers 38 are provided in positions corresponding to the roller portions of the transfer roller 32, and are pressed to the roller portions by a spring shaft (not shown) under a pressing force of about 100 gf. The transfer roller 32 is rocked by a transfer roller rocking mechanism to be explained later, and is switched between a contact state and a non-contact state to the pinch rollers 38.

Figure 5:
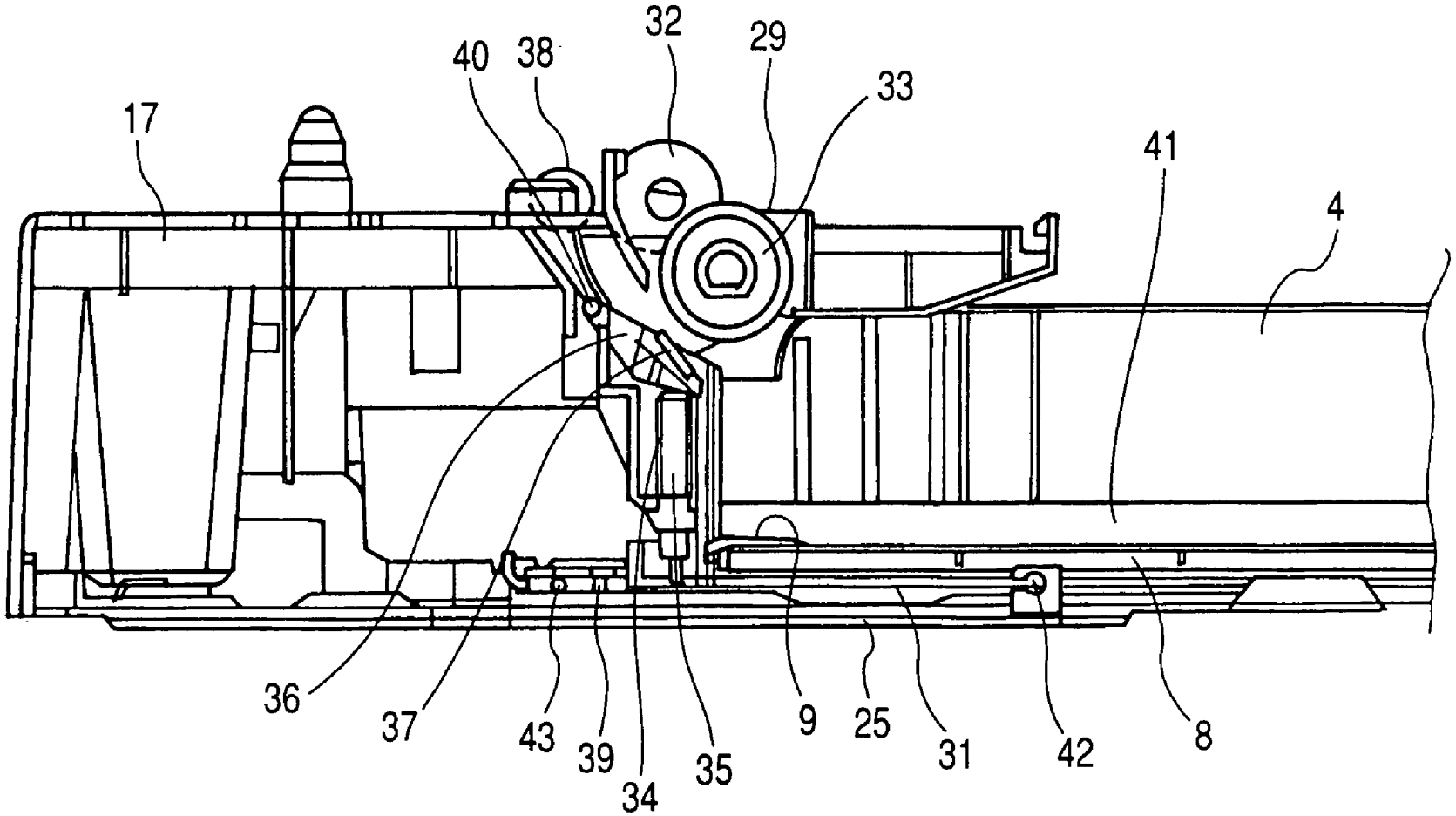
FIG. 5 is a cross-sectional view showing an initial state of a feeding roller rubber, sectioned at a center in an axial direction thereof.
Figure 6:
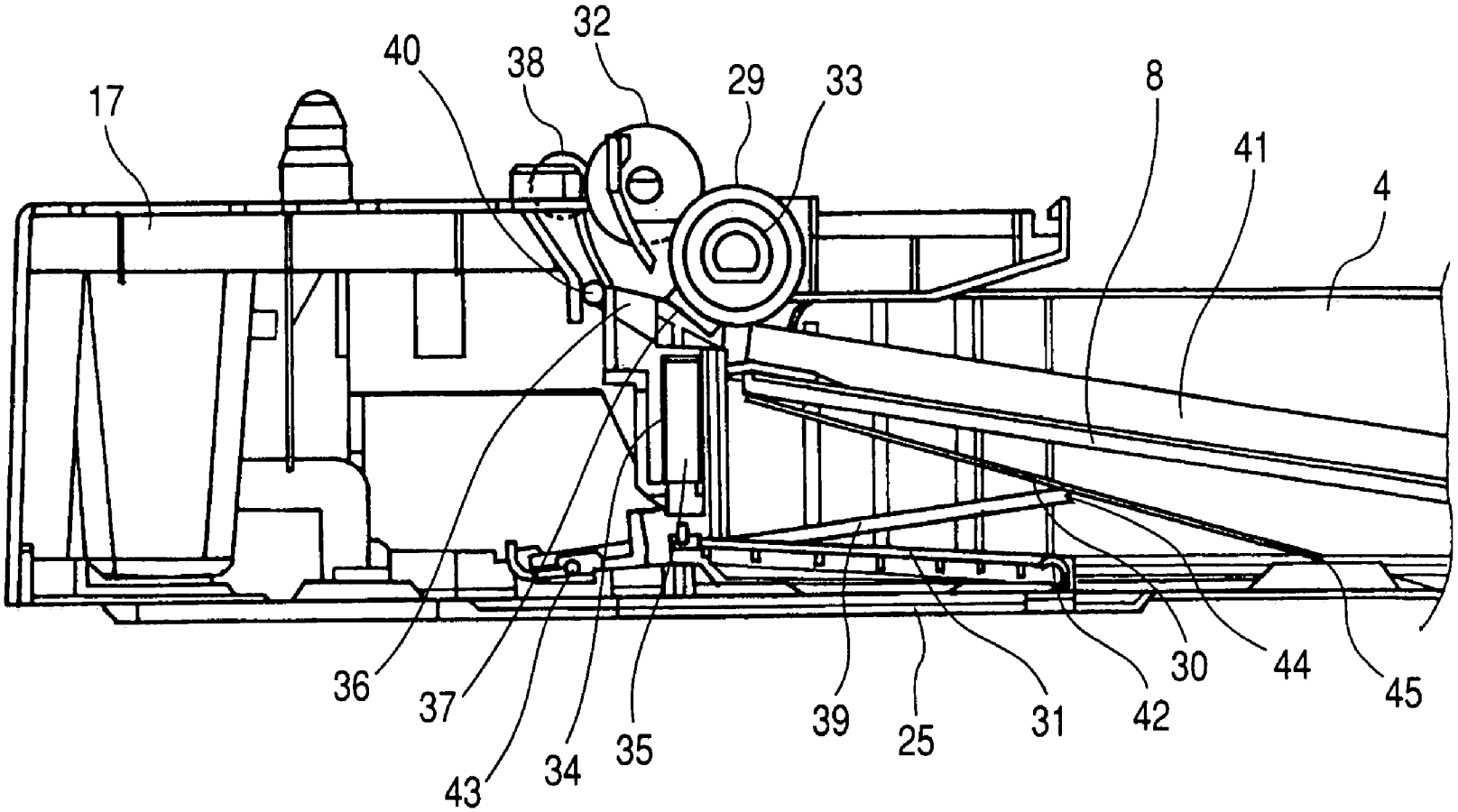
FIG. 6 is a cross-sectional view showing a state under feeding of a feeding roller rubber, sectioned at a center in an axial direction thereof.
Figure 7:
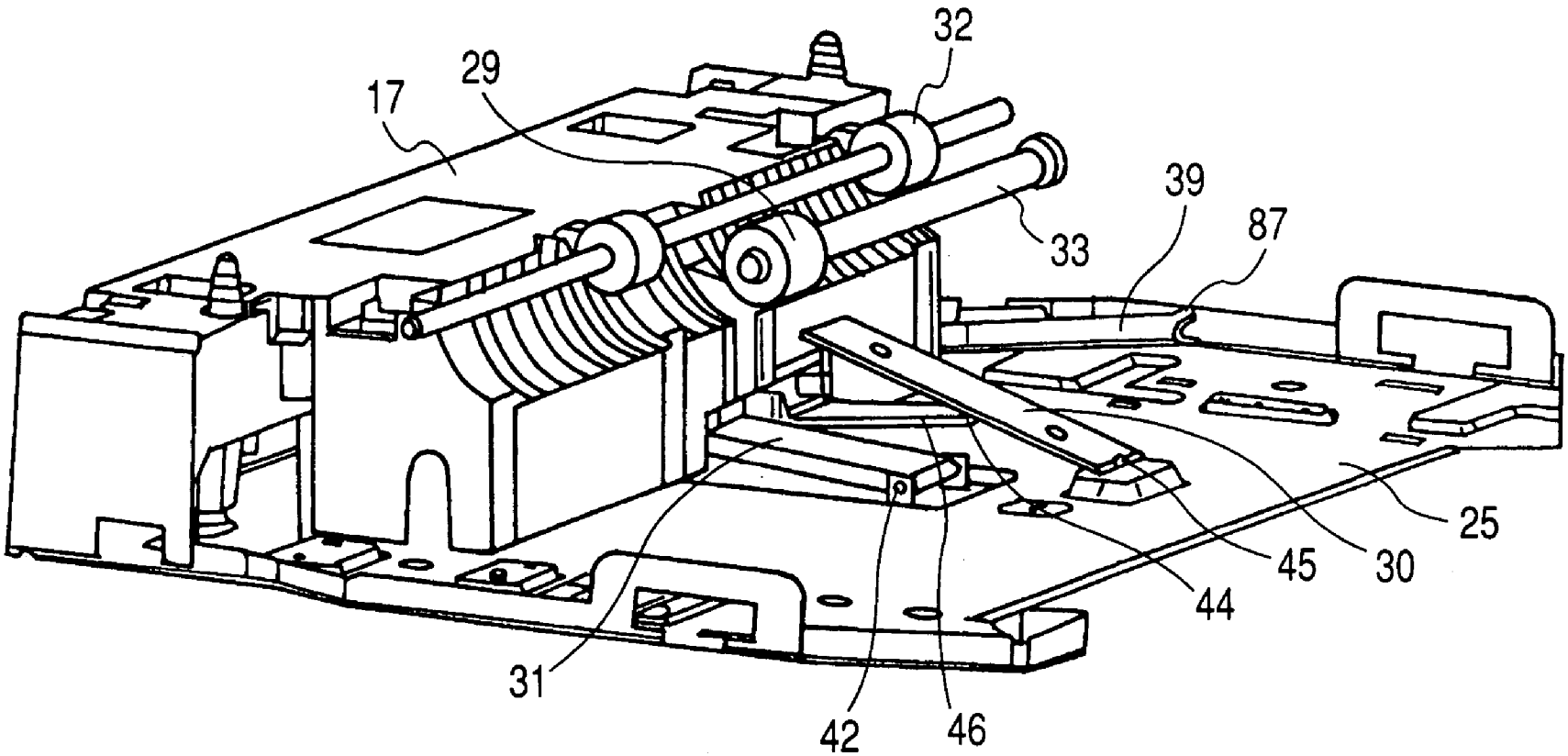
FIG. 7 is a perspective view showing first and second pressure plate pressing plates in a state shown in FIG. 6.

FIG. 5 is a cross-sectional view of the feeding roller rubber 29, sectioned at the center in the axial direction, showing an initial state in which the pressure plate 8 is lowered. FIG. 6 is a cross-sectional view showing a state in the course of feeding of the recording medium, in which the pressure plate 8 is elevated. FIGS. 5 and 6 show the feeding cassette 3 and the recording medium 41 in addition to the unit main body portion 2 shown in FIG. 4. FIG. 7 is a perspective view showing the first pressure plate pressing plate and the second pressure plate pressing plate in a state shown in FIG. 6, wherein some components are omitted for the purpose of clarity.

The unit main body portion 2 is provided with a feeding mechanism for feeding the recording medium 41 and a separating mechanism for separating the recording medium one by one. In the following, configurations of the feeding mechanism and the separating mechanism will be explained with reference to FIGS. 4 to 7.

The feeding mechanism provided in the unit main body portion 2 includes, as shown in FIGS. 5 and 6, a first pressure plate pressing metal plate 30 (first movable plate) for vertically moving the pressure plate 8 in contact therewith, and a second pressure plate pressing metal plate 39 (second movable plate) for rotating the first pressure plate pressing plate 30. The second pressure plate pressing metal plate 39 is formed into an approximately square-U shape and is partly positioned under the separation base 17.

The separating mechanism constituting medium separating means provided in the unit main body portion 2 includes a separating pad 37 to be contacted with the recording medium 41, a separating pad holder 36 capable of rotating the separating pad 37 between a contact position contacted with the recording medium and a non-contact position separated therefrom, and a rocking plate 31 for rotating the separating pad holder 36.

The separating pad 37 is formed by a foamed urethane material having a friction coefficient of 1.1 or higher to the recording medium 41. The separating pad 37 is adhered, for example with a double-side adhesive tape, on the separating pad holder 36. The separating pad holder 36 is provided rotatably about a rotary shaft 40 provided on the separation base 17. In an initial state (FIG. 5), the separating pad holder 36 is rotated clockwise by a weight thereof and is stopped in contact with a stopper (not shown) provided on the separation base 17, thereby being maintained in a separated position in which the separating pad 37 is separated from the feeding roller rubber 29.

Below the separating pad holder 36, a separating pad shaft 35 is fitted in a hole provided in the separation base 17 and is rendered movable in a vertical direction in FIG. 5. On the external periphery of the separating pad shaft 35, there is provided a compression coil spring 34, into which the separating pad shaft 35 is inserted. The compression coil spring 34 impinges at a lower end thereof on the separation base 17 while improves at an upper end thereof on a flange portion of the separating pad shaft 35, thereby applying an upward biasing load of about 50 to 100 gf to the separating pad shaft 35. The separating pad shaft 35 is provided, at a lower end thereof, with a larger diameter portion which engages with a U-shaped engaging portion (not shown) formed in the rocking plate 31.

The rocking plate 31 is provided rotatably about a rotary shaft 42 supported by the base plate 25. In a state shown in FIG. 5, the rocking plate 31 is pressed by a pressing portion 46 to be explained later and is maintained in a substantially horizontal position.

The second pressure plate pressing plate 39 is supported, at a base end thereof, rotatably about a rotary shaft 43 provided on the base plate 25, and is maintained, at a front end portion 44, in contact with the first pressure plate pressing plate 30 as shown in FIGS. 6 and 7. The second pressure plate pressing plate 39, upon being rotated, rotates and lifts the first pressure plate pressing plate 30 from the base plate 25.

The first pressure plate pressing plate 30 is inserted, at a bent portion 45 formed at an end, into a hole in the base plate 25 and is rendered rotatable about such bent portion 45. Therefore, an upward rotation of the second pressure plate pressing plate 39 causes an upward rotation of the first pressure plate pressing plate 30. Since the first pressure plate pressing plate 30 is contacted with the pressure plate 8 as described above, the pressure plate 8 can be moved vertically between the contact position and the separated position by the rotation of the second pressure plate pressing plate 39.

FIG. 6 shows a state where the pressure plate 8 is elevated to contact the recording medium 41 with the feeding roller rubber 29 for feeding the recording medium 41. The second pressure plate pressing plate 39 is provided with a pressing portion 46 for pressing a part of the rocking plate 31, and, when the second pressure plate pressing plate 39 is rotated upward from the horizontal state, the rocking plate 31 is also lifted by rotation, whereby the separating pad shaft 35 slides upwards by the load of the compression coil spring 34. As the separating pad shaft 35 lifts a lower face of the separating pad holder 36, whereby the separating pad 37 is pressed to the feeding roller rubber 29. The rocking plate 31 no longer rotates at this point, and a further lifting of the second pressure plate pressing plate 39 shifts the contact load of the separating pad 37 to about 50 gf.

Then, reference is made again to FIG. 4 for explaining the second pressure plate pressing plate 39, the feeding roller shaft 33, the transfer roller 32 and the transfer roller rocking mechanism.

Figure 18:
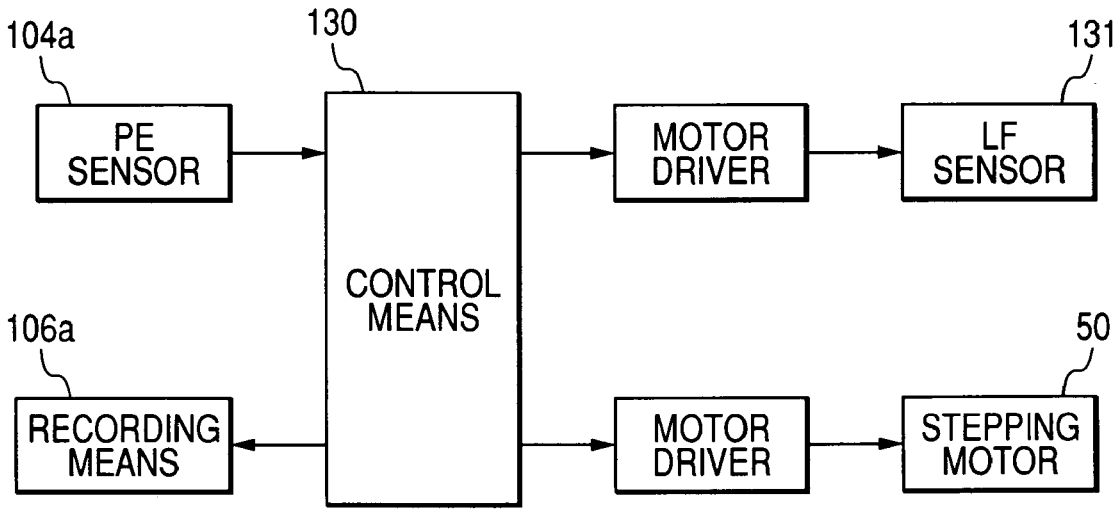
FIG. 18 is a control circuit diagram of a recording apparatus.

As shown in FIG. 4, a right-side chassis 48 and a left-side chassis 49 are fixed on the base plate 25 with screws. The right-side chassis 48 includes a stepping motor 50 as a driving source for transmitting a driving power to the pressure plate 8 and the feeding roller rubber 29. The stepping motor 50 is controlling in a forward rotating direction or a reverse rotating direction, by a control circuit portion 130 (FIG. 18), constituting control means provided in the main body 100 of the recording apparatus.

The control circuit portion 130 also controls an LF motor 131, a carriage 106 and a recording head 106*a* to be explained later.

Figure 8:
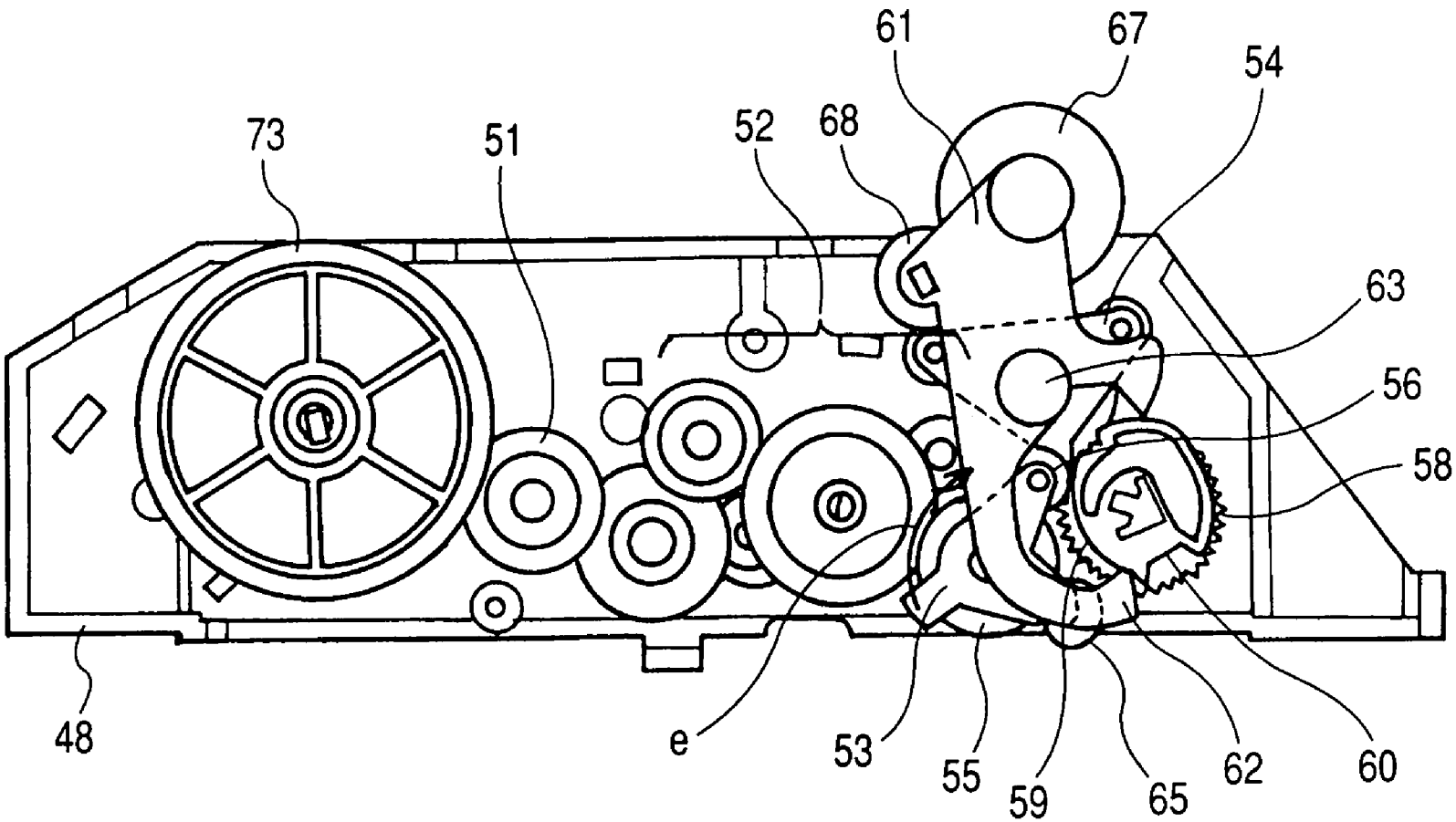
FIG. 8 is a lateral view seen from outside of a right-side chassis.

FIG. 8 is a lateral view of a transfer roller rocking mechanism, provided on the right-side chassis 48, seen from outside of the right-side chassis 48. For facilitating the understanding, the stepping motor 50 is omitted in FIG. 8. FIG. 8 shows an initial state prior to the start of feeding of the recording medium 41, in which a transfer roller gear 67, provided coaxially with the transfer roller 32, is in a released state.

An idler gear 51 meshes with a drive gear (not shown) on a rotary shaft of the stepping motor 50. As shown in FIG. 8, the idler gear 51 transmits the driving power of the stepping motor 50, through an idler gear train 52, respectively to first and second pendulum gear units 53, 54.

At first the first pendulum gear unit 53 will be explained with reference to FIG. 9 which is a magnified view of the vicinity of the first pendulum gear unit 53.

Figure 9:
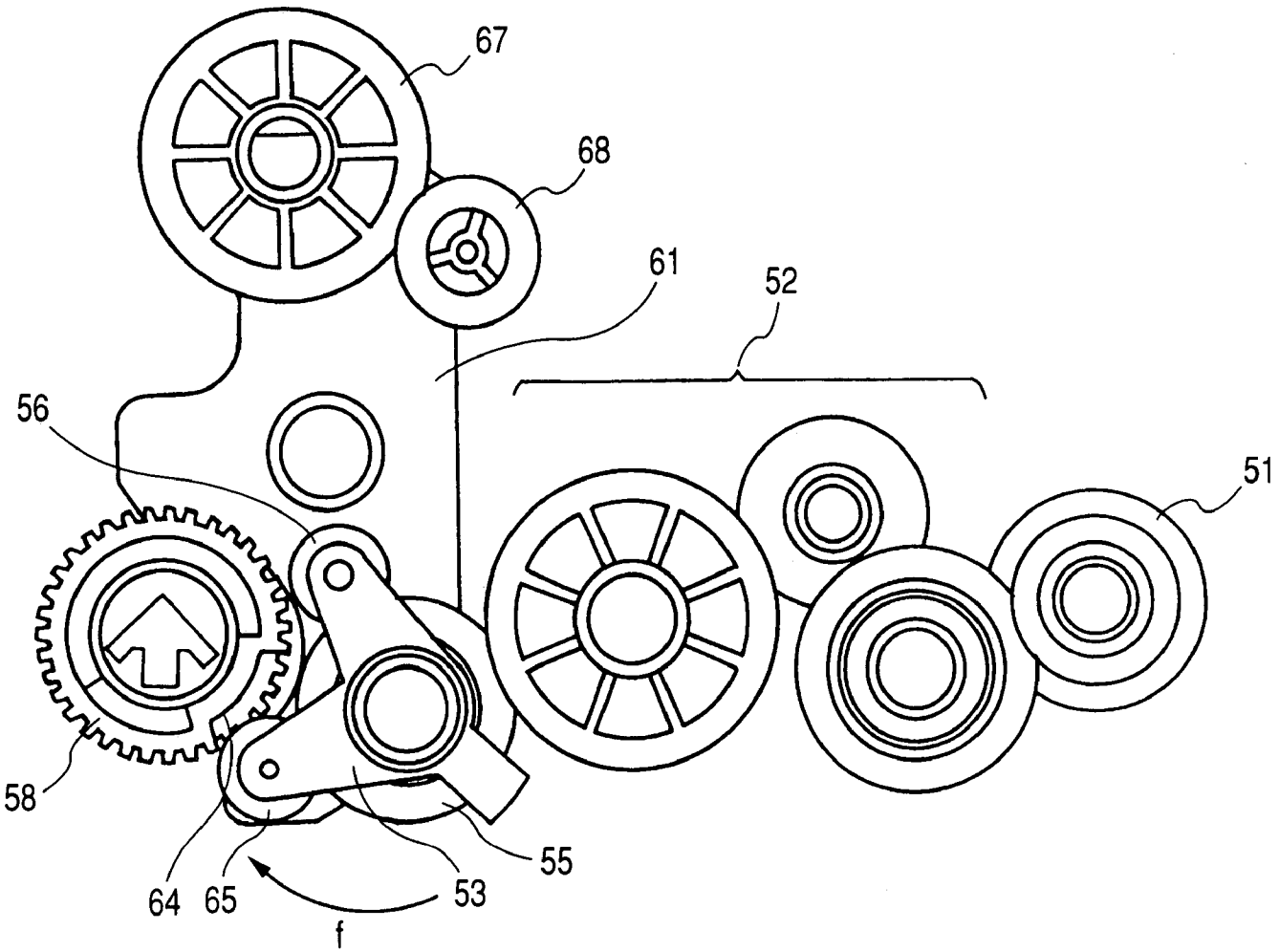
FIG. 9 is a schematic view showing a vicinity of a first pendulum gear unit seen from inside of the right-side chassis.

FIG. 9 is a schematic view seen from the inside of the right-side chassis 48. FIG. 8 shows an initial state prior to the start of the feeding operation, while FIG. 9 shows a state in the course of a feeding operation.

In the initial state, as shown in FIG. 8, the first pendulum gear unit 53 is rocked in a direction e in FIG. 8. Since the stepping motor 50 is reversed before reaching this initial state as will be explained later, the first pendulum gear unit 53 is rocked to this initial position.

The first pendulum gear unit 53 is rendered capable of a rocking motion about a rotation center of a solar gear 55, and rotatably supports planet gears 56, 65 meshing with the solar gear 55. Also in a position adjacent to the first pendulum gear unit 53, there is provided a rocking cam gear 58, which is provided at an end of a cam shaft 98 (cf. FIG. 16) having a toothless portion 59, a toothless portion 64 and a cam portion 60. Such toothless portions 59, 64 are shifted in the axial direction of the cam shaft 98 of the rocking cam gear 58, and the planet gears 56, 65 are also shifted in the axial direction of the rotary shaft, matching the positions of the toothless portions 59, 64.

In the initial position of the first pendulum gear unit 53, the planet gear 56 meshes with the rocking cam gear 58 through the solar gear 55. In the first pendulum gear unit 53, the rocking cam gear 58 is rotated by the rotation of the planet gear 56, and, when the rocking cam gear 58 is rotated to a position where the toothless portion thereof corresponds to the planet gear 56, the meshing state of the planet gear 56 and the rocking cam gear 58 is released. Therefore, even when the stepping motor 50 continues to be driven in the reverse direction, the driving power transmitted to the planet gear 56 is not transmitted to the rocking cam gear 58 to attain a power non-transmitting state, whereby the rocking cam gear 58 is stopped in a state shown in FIG. 8. As shown in FIG. 8, a rocking lever 61 has a cam follower portion 62 slidable along the cam portion 60 of the rocking cam gear 58. By a displacement of the cam follower portion 62 along the cam portion 60 of the rocking cam gear 58, the entire rocking lever 61 rocks about a lever shaft 63.

In feeding the recording medium 41 by a forward rotation of the stepping motor 50 from the state shown in FIG. 8, the rocking cam gear 58 is rotated counterclockwise in FIG. 8. In such state, the first pendulum gear unit 53 is rocked in a direction f in FIG. 9, whereby the planet gear 65 meshes with the rocking cam gear 58 through the solar gear 55.

In the first pendulum gear unit 53, as in the case where the stepping motor 50 is rotated in the reverse direction, the rocking cam gear 58 is rotated by the rotation of the planet gear 65, and, when the rocking cam gear 58 is rotated to a position where the toothless portion 64 thereof corresponds to the planet gear 65, the meshing state of the planet gear 65 and the rocking cam gear 58 is released. Therefore, even when the stepping motor 50 continues to be driven in the forward direction, the driving power transmitted to the planet gear 65 is not transmitted to the rocking cam gear 58 to attain a power non-transmitting state, whereby the rocking cam gear 58 is stopped in a state shown in FIG. 9.

Thus, by rotating the stopping motor 50 in the forward direction and in the reverse direction, the planet gear 65 is reciprocated within a range of a rotation angle of 110°, and the rocking lever 61 is also reciprocated within a range of a rotation angle of 7.5°. The width of such rocking motion is determined by a mechanical configuration and does not require a precision in the stopping position of the stepping motor 50.

As shown in FIGS. 8 and 9, the rocking lever 61 rotatably supports a transfer roller gear 67 fixed at an end of a shaft of the transfer roller 32, and similar supports also a conveying idler gear 68.

Figure 16:
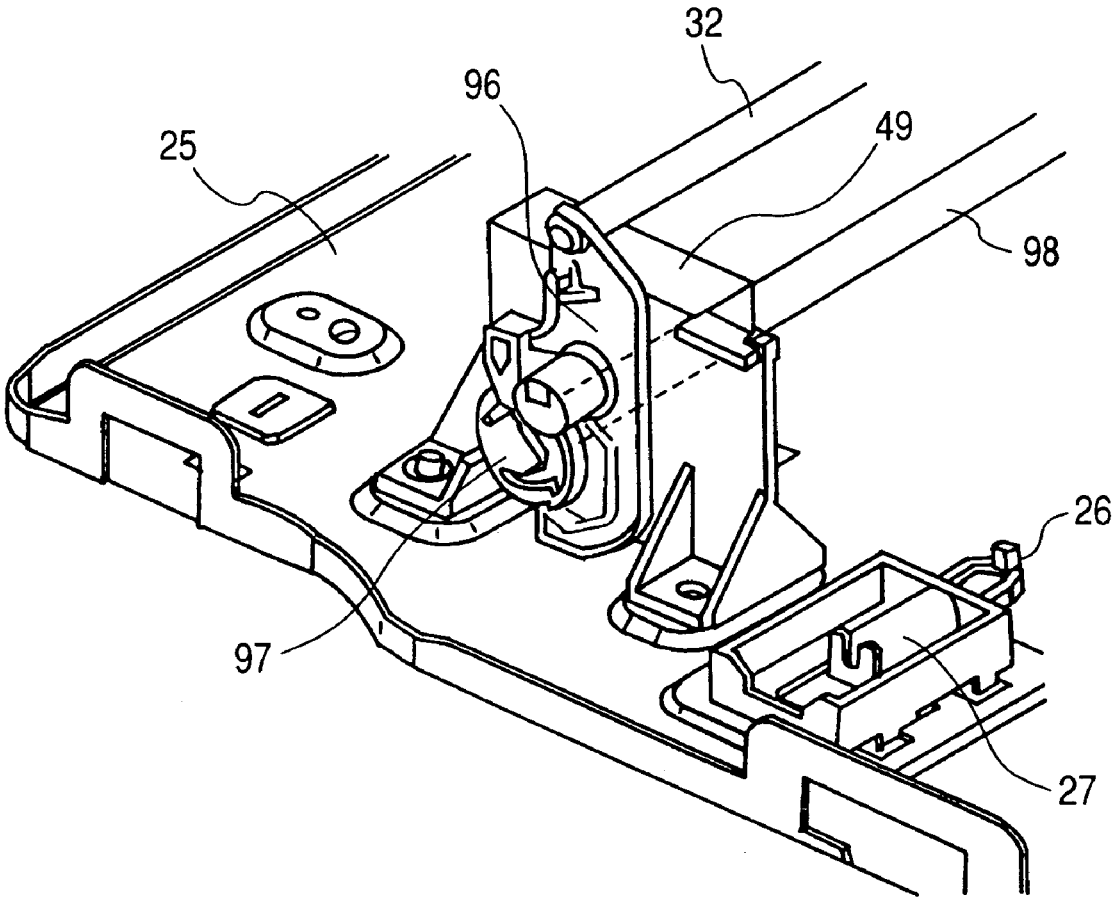
FIG. 16 is a perspective view showing a vicinity of a left-side chassis.

As shown in FIGS. 4 and 16, the left-side chassis 49 is provided with a rocking lever 96, formed in a similar shape as the aforementioned rocking lever 61. FIG. 16 is a perspective view showing the vicinity of the left-side chassis 49. As shown in FIG. 16, the other end of the shaft of the transfer roller 32 is supported rotatably by the rocking lever 96. Also the cam shaft 98, having the rocking cam gear 58 at an end, is provided with a cam portion 97 at the other end. The cam portion 97 has a cam shape similar to that of the cam portion 60 of the rocking cam gear 58, and is rotated through the cam shaft 97 by the rotation of the rocking cam gear 58.

Therefore, the transfer roller 32, supported by the rocking levers 61, 96 respectively provided in the right-side chassis 48 and the left-side chassis 49, executes a rocking motion in a direction of approaching to and being separated from the pinch roller 38 by the rocking motion of the rocking levers 61, 96. The rocking lever 61, the rocking lever 96, the idler gear 51, the idler gear train 52, the first pendulum gear unit 53, the rocking cam gear 58 and the cam portion 60 constitute contact/separating means which contacts and separates the transfer roller 32 and the pinch roller 38.

Then, the other second pendulum gear unit 54 will be explained with reference to FIG. 10 which is a schematic view showing a state in the course of feeding and seen from the inside of the right-side chassis 48 as in FIG. 9.

The second pendulum gear unit 54 has a rocking center coaxial with the rocking center of the rocking lever 61.

Figure 10:
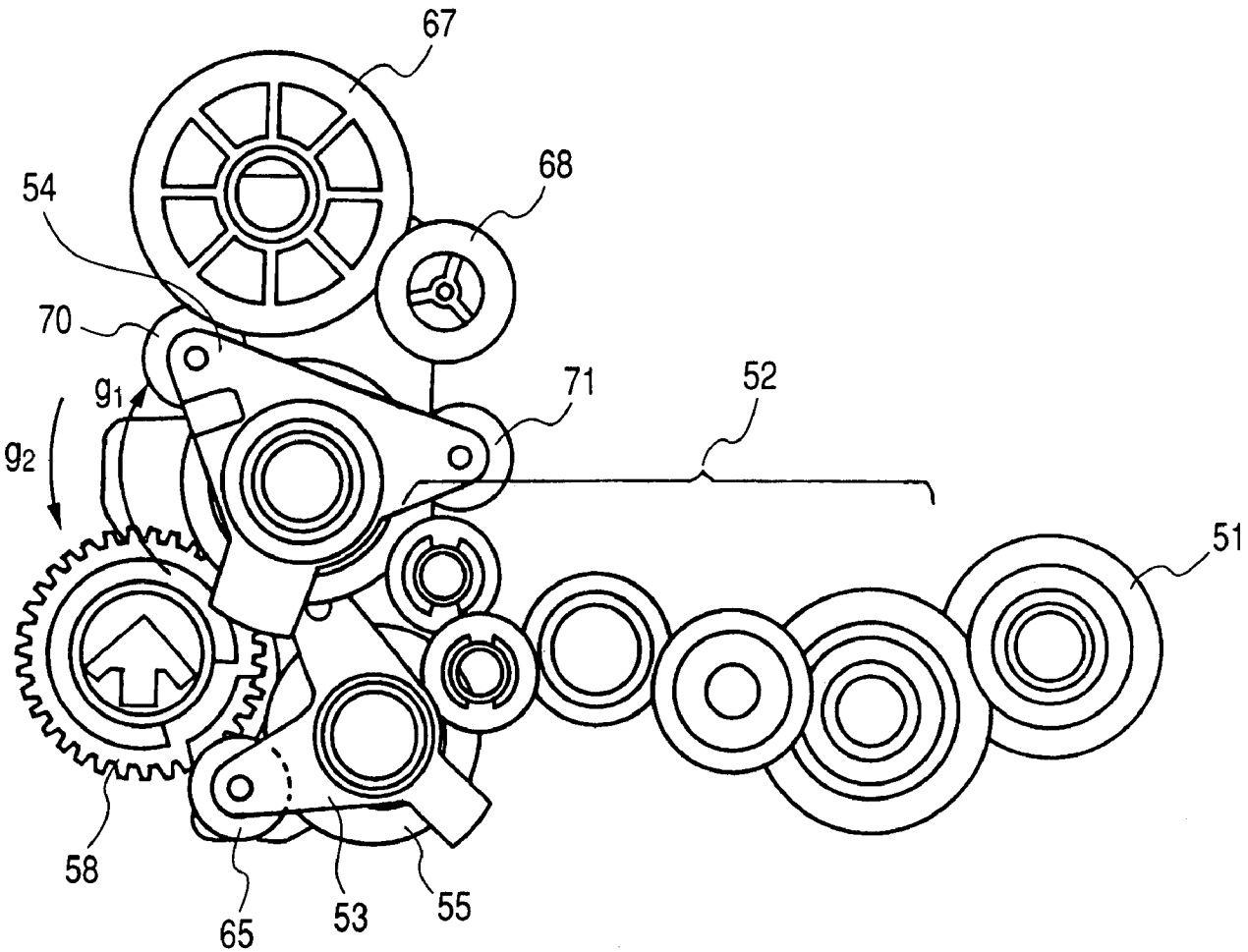
FIG. 10 is a schematic view showing a vicinity of a second pendulum gear unit seen from inside of the right-side chassis.

During a feeding operation in which the stepping motor 50 is rotated in the forward direction, the second pendulum gear unit 54 is rocked in a direction g1 in FIG. 10 and a planet gear 70 meshes with a transfer roller gear 67.

When the stepping motor 50 is rotated in the reverse direction, the second pendulum gear unit 54 rocks in a direction g2 in FIG. 10, whereby a planet gear 71 meshes with a transfer idler gear 68. Even when the rocking lever 61 is rocked, the second pendulum gear unit 54 and the rocking lever 61 are so constructed as to mutually impinge and to be determined in position by a stopper (not shown).

Thus, regardless of the rotating direction of the stepping motor 50 in the forward or reverse direction, the transfer roller gear 67 is constantly rotated in a direction (clockwise in FIG. 10) for transferring the recording medium 41 toward the main body 100 of the recording apparatus. The idler gear 51, the idler gear train 52, the second pendulum gear unit 54, the transfer gear roller 67 and the idler gear 68 constitute third drive transmission means.

In the following, there will be explained the driving power transmission by the second pressure plate pressing plate 39 and the feeding roller shaft 33.

As shown in FIG. 8, the idler gear 51 receiving the driving power from the stepping motor 50 transmits the driving power through an idler gear 73 to a gear train provided inside the right-side chassis 48.

Figure 11:
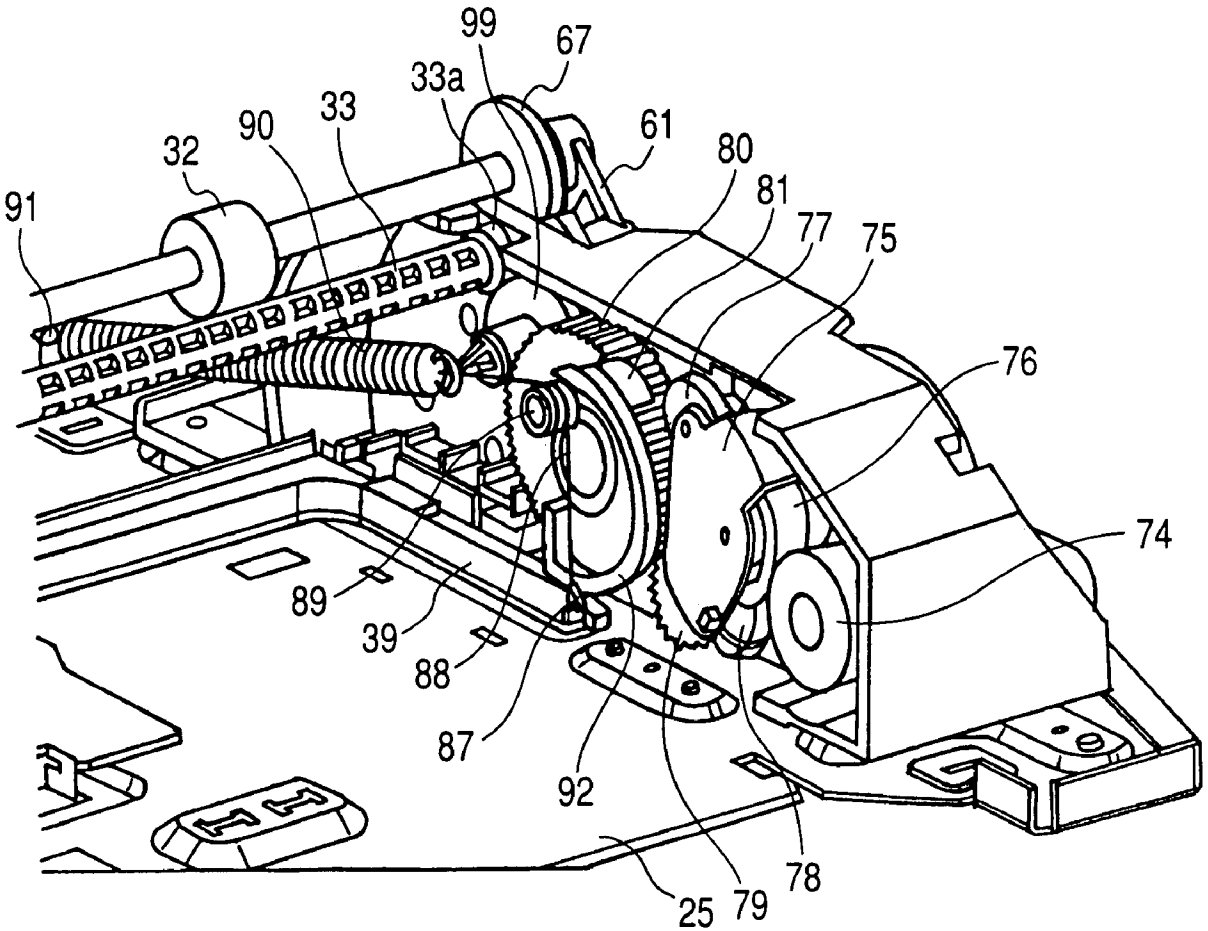
FIG. 11 is a perspective view showing an inside of the right-side chassis.
Figure 12:
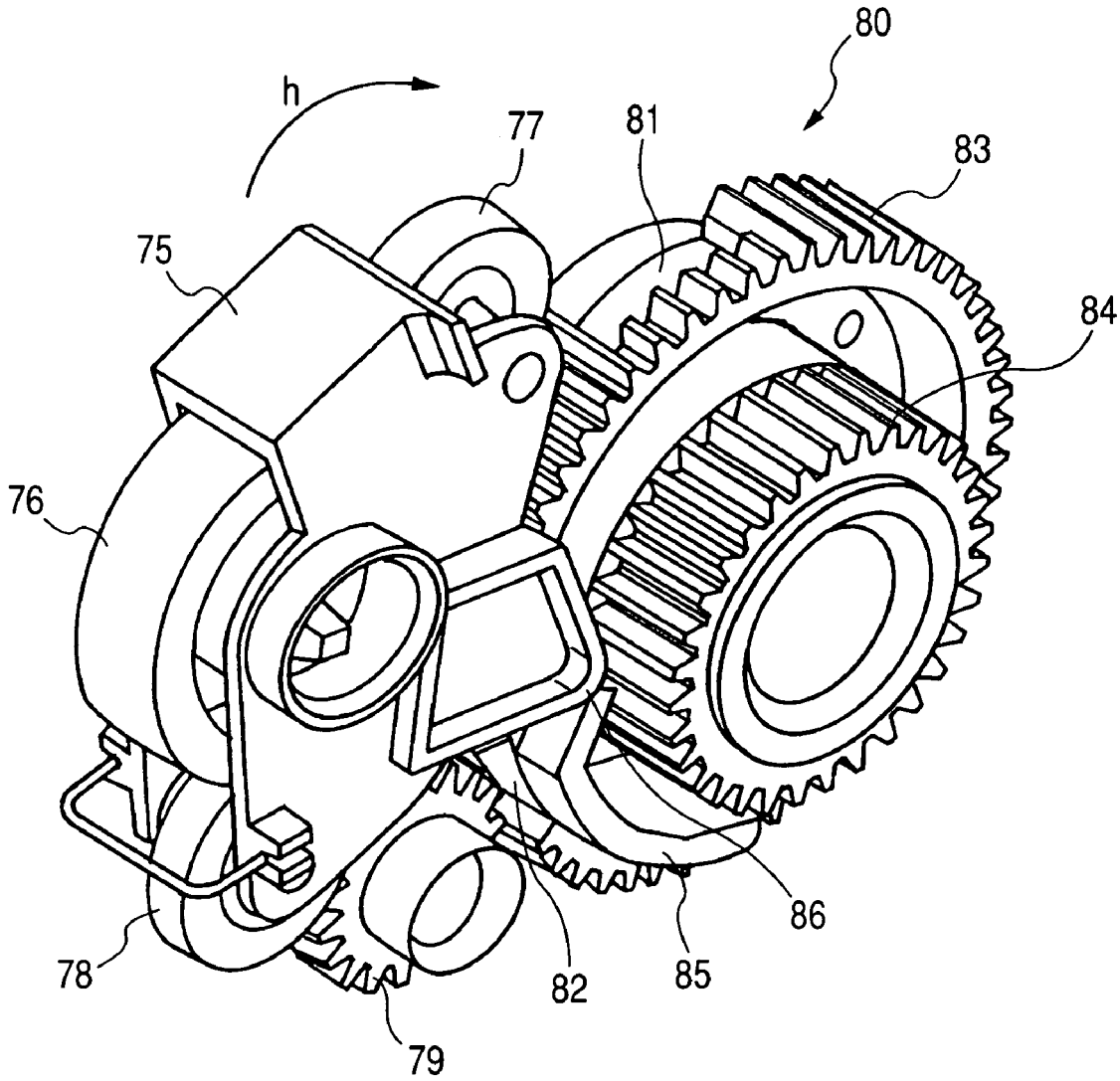
FIG. 12 is a perspective view showing a pressure plate pendulum gear unit seen from a rear side.

FIG. 11 is a perspective view showing the inside of the right-side chassis 48, omitting certain components for the purpose of clarity. As shown in FIG. 11, an idler gear 73 meshing with the idler gear 73 is provided inside the right-side chassis 48. The idler gear 74 meshes with a solar gear 76 provided in a pressure plate pendulum gear unit 75 for transmitting the driving power of the stepping motor 50 to the feeding roller rubber 29. The pressure plate pendulum gear unit 75 is provided with a first planet gear 77 and a second planet gear 78 respectively meshing with the solar gear 76. FIG. 11 shows an initial state prior to a feeding, in which the planet gear 78 and the pressure plate idler gear 79 are stopped in a mutually meshing state. FIG. 12 is a detailed perspective view showing such state seen from the rear side.

As shown in FIGS. 11 and 12, in a position adjacent to the pressure plate pendulum gear unit 75, there is provided the pressure plate cam gear 80 for controlling the vertical movement of the pressure plate 8, explained in the foregoing with reference to FIGS. 5 and 6. The pressure plate cam gear 80 is constructed as a two-step gear, having an external gear portion 83 and an internal gear portion 84. The external gear portion 83 is provided with toothless portions 81, 82 for achieving a power non-transmitting state, in positions displaced in the axial direction. The idler gears 73, 74, the pressure plate pendulum gear unit 75, the pressure plate cam gear 80 etc. constitute first drive transmission means.

In the state shown in FIGS. 11 and 12, the pressure plate idler gear 79 is positioned corresponding to the second toothless portion 82 and is in a non-transmitting state. The internal gear portion 84 of the pressure plate cam gear 80 meshes with a feeding idler gear 99 which meshes with a gear portion 33*a* provided integrally at an end of the feeding roller shaft 33. Therefore, the pressure plate cam gear 80, upon being rotated, transmits the driving power to the feeding roller shaft 33. Consequently, the feeding roller shaft 33 and the feeding roller rubber 29 are rotated and stopped in synchronization with the up-down operation of the pressure plate 8. The idler gears 73, 74, the pressure plate pendulum gear unit 75, the pressure plate cam gear 80, the feeding idler gear 99 and the gear portion 33*a* of the feeding roller shaft 33 constitute second drive transmission means.

As shown in FIGS. 7 and 11, a metal wire 88 engages at an end thereof with a wire engaging portion 87 of the aforementioned second pressure plate pressing plate 39, then is wound on a wire pulley (direction converting means) 89 supported on a shaft 94 to be explained later by about 90° and engages on the other end with an end of a pressure plate coil spring 90 constituting pressure plate contact means. The other end of the pressure plate coil spring 90 engages with a spring engaging piece 91 formed by bending a part of the base plate 25. Therefore, the biasing direction of the pressure plate coil spring 90 is approximately perpendicularly converted in by the wire 88 and the wire pulley 89 and is applied to the second pressure plate pressing plate 39.

In this manner, the second pressure plate pressing plate 39 is given a load of about 1.3 kg by the pressure plate coil spring 90 through the wire 88, and, as explained in FIGS. 5 and 6, such load is finally converted into a contact power for pressing the pressure plate 8 to the feeding roller rubber 29. Such pressing load is set at about 250 gf in consideration of a lever ratio and the weight of the recording medium 41. However, in a state shown in FIG. 11, a cam portion 92 provided in the pressure plate cam gear 80 impinges on an end of the second pressure plate pressing plate 39, which is restricted downwards by such cam portion 92, so that the pressure plate 8 is in a lowered position.

When a feeding operation is initiated from the state shown in FIGS. 11 and 12 and the stepping motor 50 is rotated in the forward direction, the pressure plate pendulum gear unit 75 is rocked in a direction h in FIG. 12 whereby the first planet gear 77 meshes with the external gear portion 83 of the pressure plate cam gear 80, which thus starts to be rotated clockwise in FIG. 12.

Figure 13:
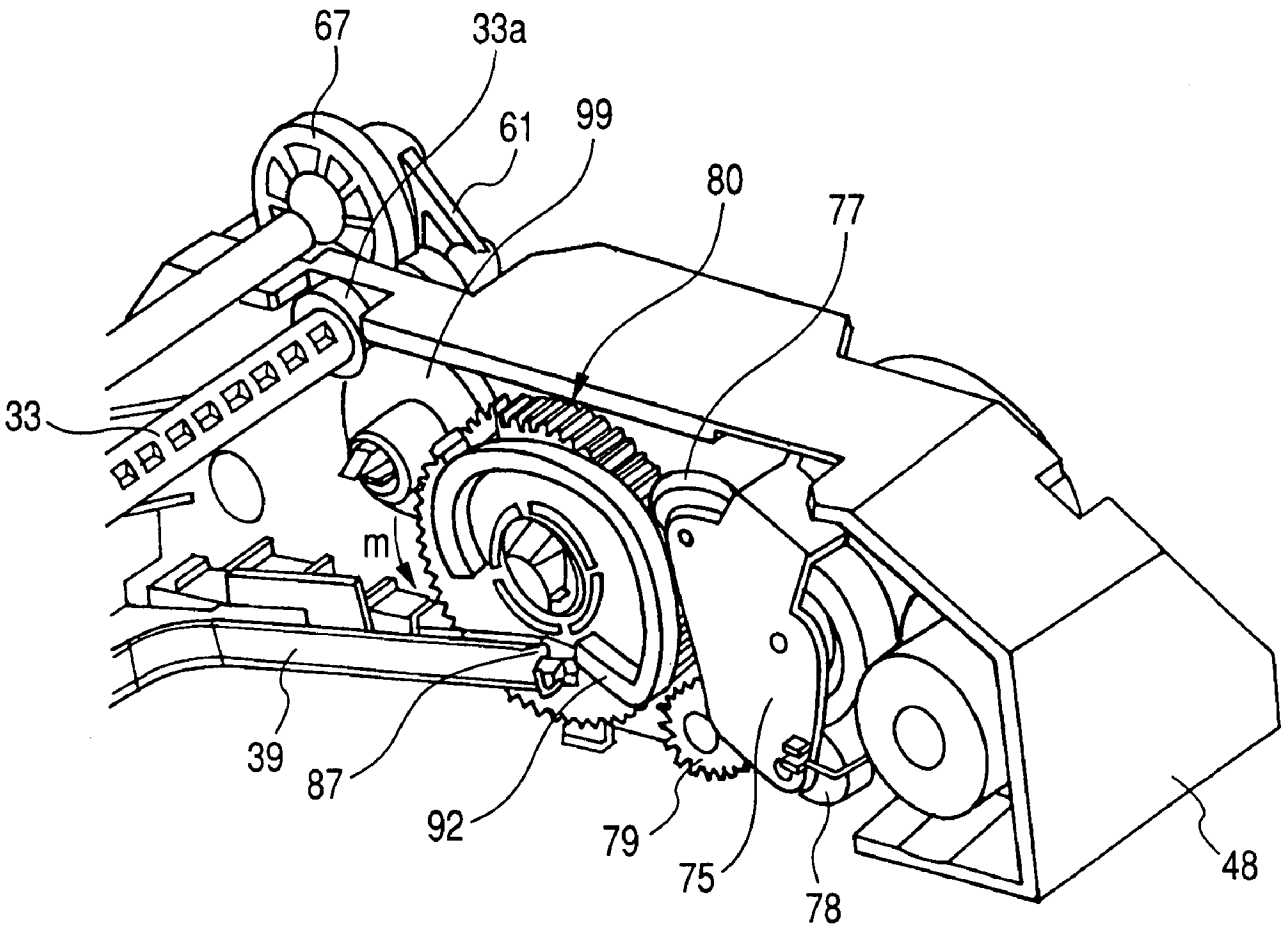
FIG. 13 is a perspective view showing a state when a pressure plate cam gear is rotated from a state shown in FIG. 11.

FIG. 13 is a perspective view showing a state where the pressure plate cam gear 80 is rotated by a small amount (pressure plate coil spring 90, wire 88 etc. being omitted from the illustration). The cam portion 92 of the pressure plate cam gear 80 is rotated in a direction m in FIG. 13 to eliminate restriction on the second pressure plate pressing plate 39, which is therefore lifted at an end thereof by the biasing force of the pressure plate coil spring 90.

In this state, the pressure plate cam gear 80 tends to rotate by the load of the spring, and, in order to avoid a situation where such load is transmitted to the pressure plate pendulum gear unit 75 to separate the planet gear 77 from the pressure plate cam gear 80 and to interrupt the transmission of the driving power, the pressure plate cam gear 80 is provided with a cam portion 80 also on a rear side thereof as shown in FIG. 12. Such cam portion 85 impinges on an end of a projection 86 provided in the pressure plate pendulum gear unit 75 to limit the position thereof, thereby preventing separation of the first planet gear 77 from the pressure plate cam gear 80.

Figure 14:
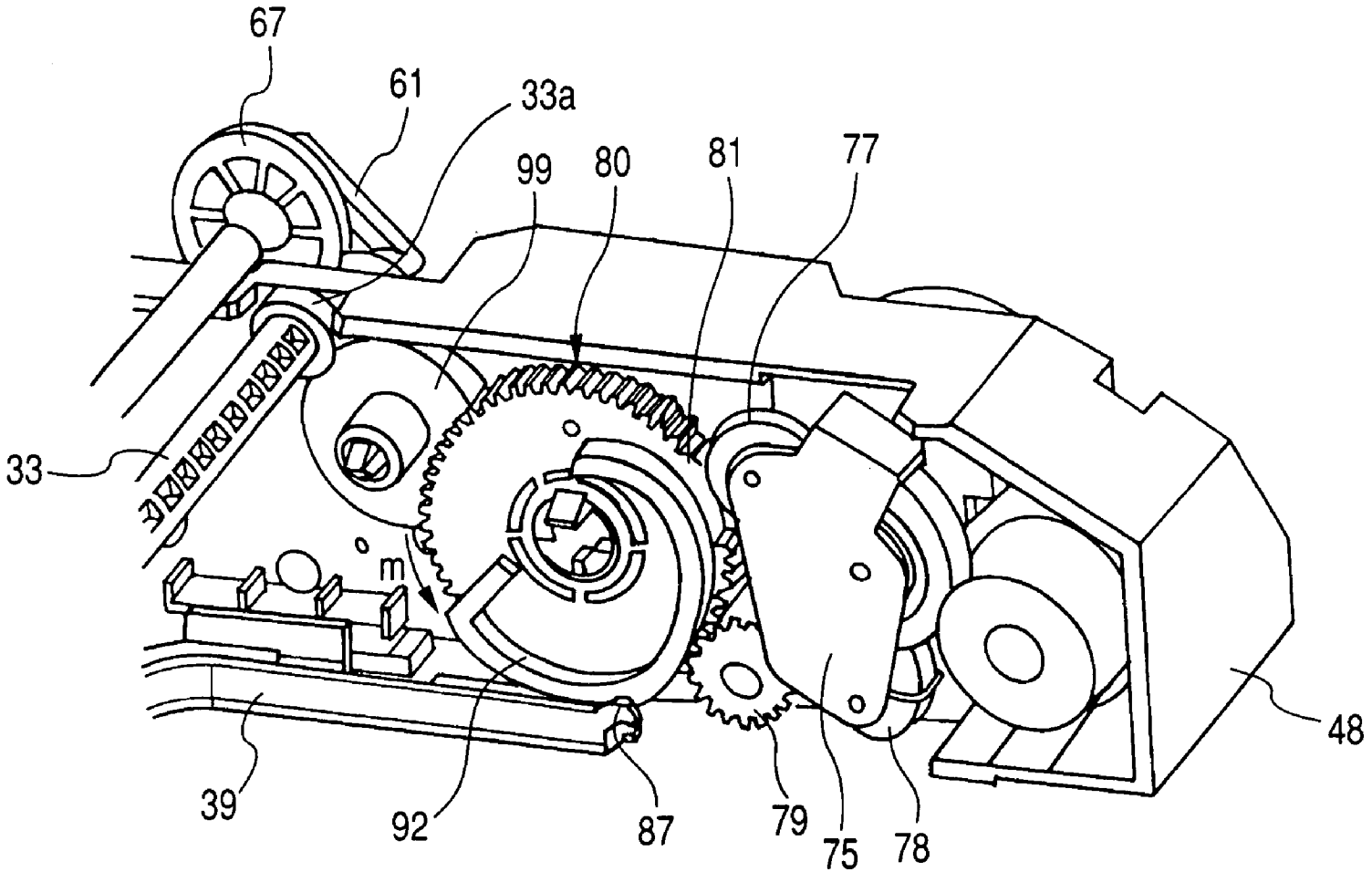
FIG. 14 is a perspective view showing a state when the pressure plate cam gear is rotated by 320° from a state shown in FIG. 11.

The cam portion 85 is required only in a section in the contracting direction of the pressure plate coil spring 90, namely a section in which the pressure plate 8 is elevated to contact the feeding roller rubber 29, so that the cam portion 85 is provided corresponding to such section. In response to the continued rotation of the pressure plate cam gear 80, the second pressure plate pressing plate 39 is once elevated and is then lowered again. When the pressure plate cam gear 80 is rotated to a rotational position shown in FIG. 14, the first toothless portion 81 reaches a state opposed to the first planet gear 77, thereby reaching a power non-transmitting state.

Within a period from the initial state shown in FIG. 11 to the power non-transmitting state, the pressure plate cam gear 80 is rotated by an angle of 320°. The feeding operation for a recording medium 41 is completed by the operations up to this point, and is thereafter transferred to the main body 100 of the recording apparatus by the transfer roller 32 only. By rotating the stepping motor 50 in the reverse direction in this state, the second planet gear 78 then meshes with the pressure plate idler gear 79 and the pressure plate cam gear 80 is rotated by the pressure plate idler gear 79 in a direction m by an angle of 40°. Thus the pressure plate cam gear 80 is again moved to a position where the second toothless portion 82 is opposed to the pressure plate idler gear 79, thereby returning to the initial state. Therefore, the pressure plate cam gear 80 is constantly rotated in a direction m regardless whether the stepping motor 50 is rotated in the forward or reverse direction.

Figure 15:
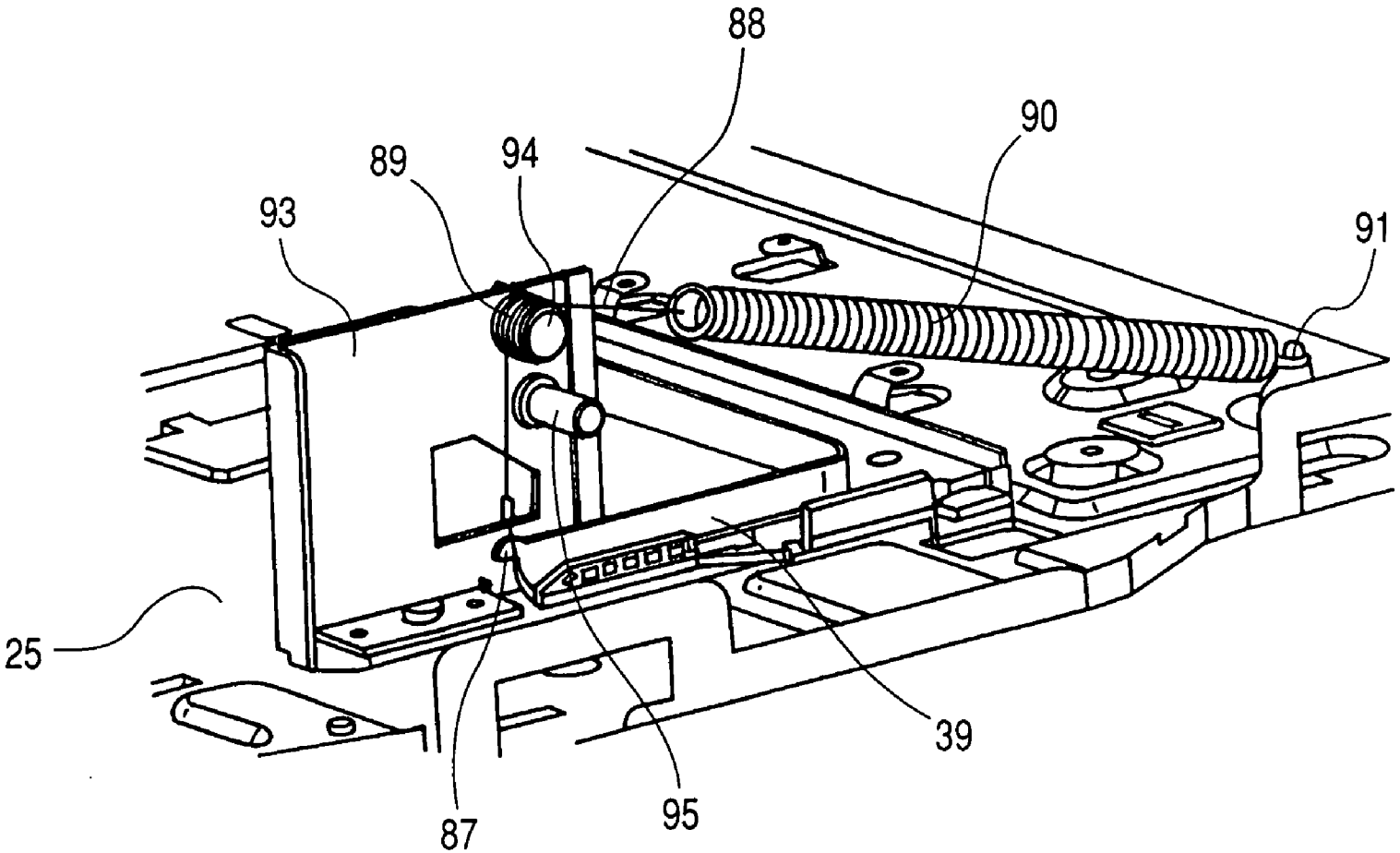
FIG. 15 is a perspective view showing a supporting structure of a wire pulley.

FIG. 15 is a perspective view showing a support structure of the wire pulley 89, omitted in FIG. 11. As shown in FIG. 15, on the base plate 25, there is provided a supporting plate 93 on which a shaft 94 for supporting the wire pulley, on which the wire 88 is wound, and a shaft 95 rotatably supporting the pressure plate cam gear 80 provided inside the right-side chassis 48 are fixed by caulking. The wire pulley 89 is caulked integrally in an axially fixed position by a flange of the shaft 94.

In the following, there will be explained a schematic configuration when the main body 100 of the recording apparatus is mounted on the cassette feeding unit 1. FIG. 1 is a perspective view showing a recording apparatus formed by mounting the main body 100 on the cassette feeding unit 1, and FIG. 17 is a cross-sectional view along a plane X in FIG. 1 and showing principal components only.

The main body 100 of the recording apparatus includes a recording portion for recording on the recording medium 41, a conveying portion for conveying the recording medium, fed from the cassette feeding unit 1, to the recording portion, and a discharge portion for discharging the recording medium 41, recorded in the recording portion, to the exterior of the apparatus.

Figure 17:
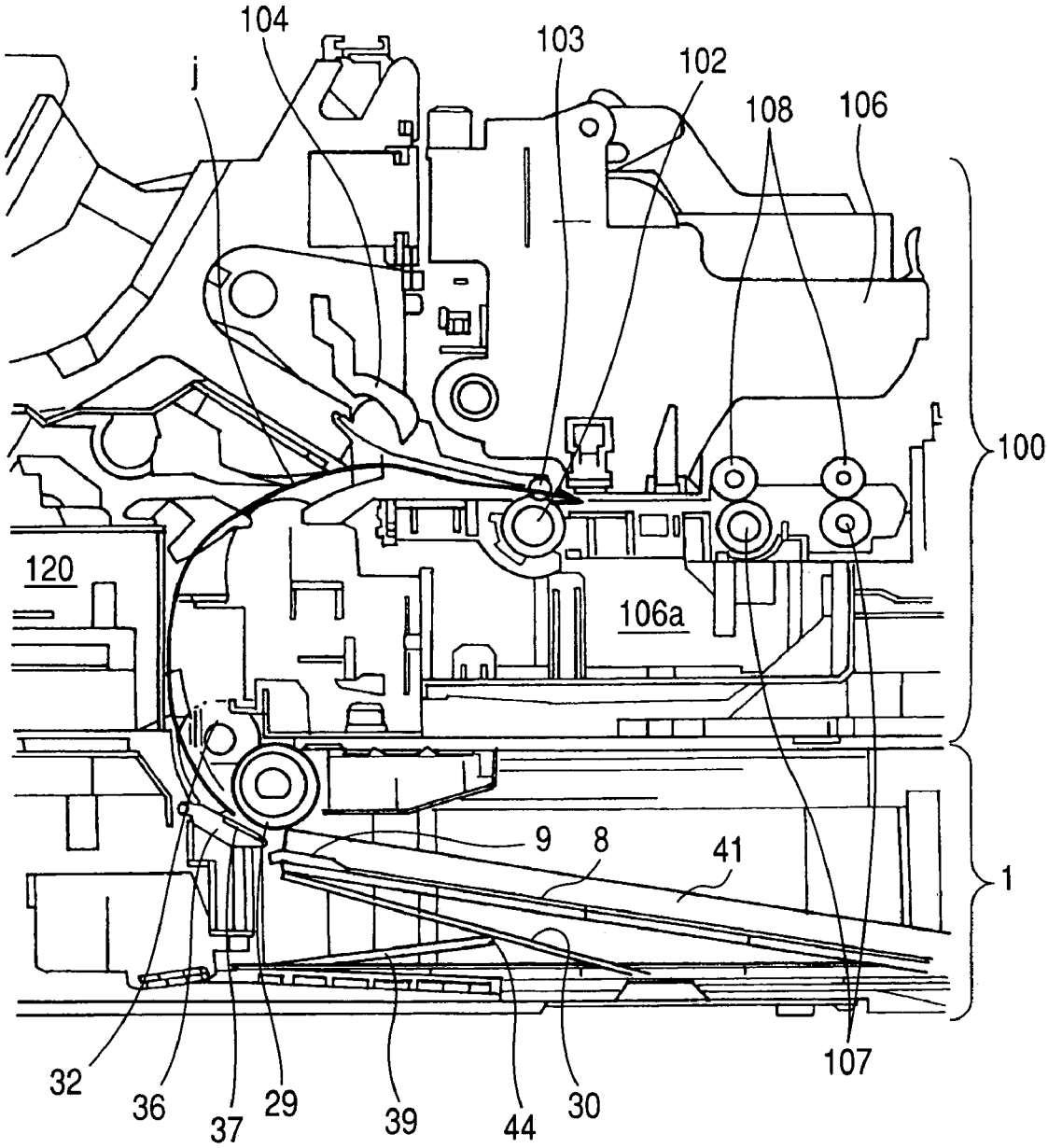
FIG. 17 is a cross-sectional view sectioned along X in FIG. 1.

As shown in FIG. 17, the conveying portion of the main body 100 of the recording apparatus is provided with an LF roller (conveying means) 102 for intermittently conveying, in a conveying path, the recording medium 41 fed by the cassette feeding unit 1. A pinch roller 103 is pressed with a predetermined load to the LF roller 102. The pinch roller 103 is provided in plural units along a main scanning direction, and correctly conveys the recording medium 41 in a sub scanning direction.

In the conveying path of the recording medium 41, for detecting a leading end and a trailing end thereof in the conveying direction, a PE (paper end) sensor lever 104 constituting detection means is provided rotatably. A lower end of the PE sensor lever 104 is rocked when a leading end or a trailing end of the recording medium 41 passes, and a transmissive photosensor 104*a* detects a movement of an upper end of the PE sensor lever 104, thereby detecting the passing time of the recording medium 41.

The recording medium 41 extracted by the feeding roller rubber 29 as explained in the foregoing, after separation into a single sheet, is transferred by the transfer roller 32 along a direction j in FIG. 17 into the main body 100 of the recording apparatus. The recording medium 41 transferred along a direction j passes through a guide member, is intermittently conveyed by being pinched between the LF roller 102 and the pinch roller 103, and is subjected to a recording operation by an ink discharge from an ink jet recording head 106*a* constituting recording means and mounted on a carriage 106 moving in a scanning motion in the main scanning direction. The recording medium 41 after the recording operation is supported by a discharge roller 107 and a spur 108 provided in the conveying portion of the main body 100 and is discharged to the exterior of the recording apparatus.

In the following, there will be explained, with reference to FIG. 19, the recording operation in the recording apparatus in a state where the cassette feeding unit 1 is mounted on the main body 100 of the recording apparatus.

The operation starts from a step S0, and at first a step S1 causes the control means 130 to rotate the stepping motor 50 in the forward direction.

The forward rotation of the stepping motor 50 is transmitted, through the idler gears 51, 73 to the idler gear 74. The rotation of the idler gear 74 is transmitted through the solar gear 76 band the planet gear 77 of the pressure plate pendulum gear unit 75, to the pressure plate cam gear 80, which in response starts to rotate clockwise in FIG. 12. The second pressure plate pressing plate 39, being freed from the restriction by the cam portion 92 of the pressure plate cam gear 80, is lifted at an end by the biasing force of the pressure plate coil spring 90, whereby the pressure plate 8 is elevated and the recording medium is brought into contact with the feeding roller rubber 29.

The forward rotation of the stepping motor 50 is also transmitted, through the internal gear portion 84 of the pressure plate cam gear 80 and the feeding idler gear 99, to the gear portion 33*a* of the feeding roller shaft 33, thereby rotating the feeding roller 29 and feeding the recording medium 41.

The forward rotation of the stepping motor 50 is also transmitted, through the idler gear 51 and the idler gear train 52, to the solar gear 55 of the first pendulum gear unit 53. The rotation of the solar gear 55 is transmitted to the planet gear 65 and the rocking cam gear 58, and the rotation of the cam portion 60 rotating integrally with the rocking cam gear 58 rotates the rocking lever 61 clockwise (FIG. 8) about the lever shaft 63, thereby pressing the transfer roller 32 to the pinch roller 38. When the transfer roller 32 is pressed to the pinch roller 38, the planet gear 65 is opposed to the toothless portion 64 of the rocking cam gear 58, whereby the rocking cam gear 58 is stopped.

The forward rotation of the stepping motor 50 is also transmitted, through the idler gear 51 and the idler gear train 52, to the solar gear 54*a* of the second pendulum gear unit 54. The second pendulum gear unit 54 rotates in a direction g1 (FIG. 10), and the rotation of the solar gear 54*a* in the direction g1 is transmitted through the planet gear 70 to the transfer roller gear 67, whereby the transfer roller 32 rotates clockwise in FIG. 6.

The recording medium 41 fed by the feeding roller 29 is conveyed, by the transfer roller 32 rotating in contact with the pinch roller 38, along a direction j in FIG. 17 into the main body 100 of the recording apparatus.

After the recording medium 41 reaches the transfer roller 32, the cam portion 92 of the pressure plate cam gear 80 in rotation presses down the second pressure plate pressing plate 39, whereby the pressure plate 8 is lowered and the recording medium 41 is separated from the feeding roller rubber 29. The recording medium 41 is conveyed, by the transfer roller 32, toward the LF roller 102 along a curved conveying path 120 in the main body of the recording apparatus. The pressure plate cam gear 80 rotates and stops at a position where the toothless portion 81 is opposed to the planet gear 77. In this state, the pressure plate 8 is in a lowest position.

In a step S2, after the leading end of the recording medium 41 is detected by the PE sensor lever 104, the transfer roller 32 advances the recording medium 41 by a distance from the PE sensor lever 104 to the LF roller 102 plus 10 mm. In this state, the recording medium 41 impinges on a contact portion between the LF roller 102 and the pinch roller 103 and then forms a loop, thereby securely maintaining the leading end of the recording medium 41 parallel to the LF roller 102 and preventing so-called skewed recording. The recording medium 41 is conveyed by 300 mm at maximum, until the leading end is detected by the PE sensor.

A step S3 discriminates whether the leading end of the recording medium 41 is detected by the PE sensor, and, if not, the flow proceeds to a step S4 to restore the initial state by reversing the stepping motor 50 by the control circuit portion 130. Then a step S5 discriminates whether the feeding operation is of second time, and, if so, a step S13 displays an error message for absence of the recording medium on a display panel (not shown) provided on the recording apparatus. In case the feeding operation is not of second time, the stepping motor 50 is rotated in the forward direction again to start the feeding operation from the step S1.

On the other hand, in case the step S3 identifies that the leading end of the recording medium 41 is detected by the PE sensor, the transfer roller 32 conveys the recording medium 41 by a distance to the LF roller 102 plus 10 mm, and then a step S6 causes the control circuit portion 130 to rotate the stepping motor 50 in the forward direction and also to drive an LF motor 13 for rotating the LF roller 102. In this manner the LF roller 102 is matched with the transfer speed of the transfer roller 102 and the recording medium 41 is conveyed for 12 mm in synchronization by the transfer roller 32 and the LF roller 102.

A step S7 causes the LF roller 102 to convey the recording medium 41 further to a recording start position, then steps the LF roller 102 and simultaneously reverses the stepping motor 50 whereupon the pressure plate cam gear 80 is rotated by an angle of 40° thereby returning to the initial position and is thus stopped. In such initial state, the transfer roller 32 is separated from the pinch roller 38, and, because of absence of a pulling resistance from the upstream side to the intermittent conveying operation by the LF roller 102, the LF roller 102 can maintain a satisfactory accuracy of conveying. Then a step S8 repeats a conveying operation by the LF roller 102 and a recording operation by the recording head 106*a* associated with the scanning motion of the carriage 106, thereby executing a recording on the recording medium 41.

A step S9 discriminates whether the recording is terminated in one page, and, if not, the flow returns to the step S8 to continue the recording operation. In case the recording is to be terminated, after the trailing end of the recording medium 41 is detected by the PE sensor lever 104, a step S10 conveys the recording medium by 120 mm, thereby discharging the recording medium 41 from the recording apparatus. The conveying is executed for 600 mm at maximum, until the trailing end of the recording medium 41 is detected by the PE sensor. A step S11 discriminates whether the trailing end of the recording medium 41 is detected by the PE sensor, and, if not, a step S12 displays a jam error for a paper jamming, but, if detected, the recording medium is discharged by conveying over 120 mm, and the sequence is terminated in a step S14.

Second Embodiment

In the foregoing first embodiment, the rocking levers 61, 96 are used to rock the transfer roller 32 thereby avoiding a detrimental influence on the conveying operation by the LF roller 102, but it is not essential to completely rock the transfer roller 32 for removing the load of the transfer roller 32 as in the first embodiment.

Figure 20:
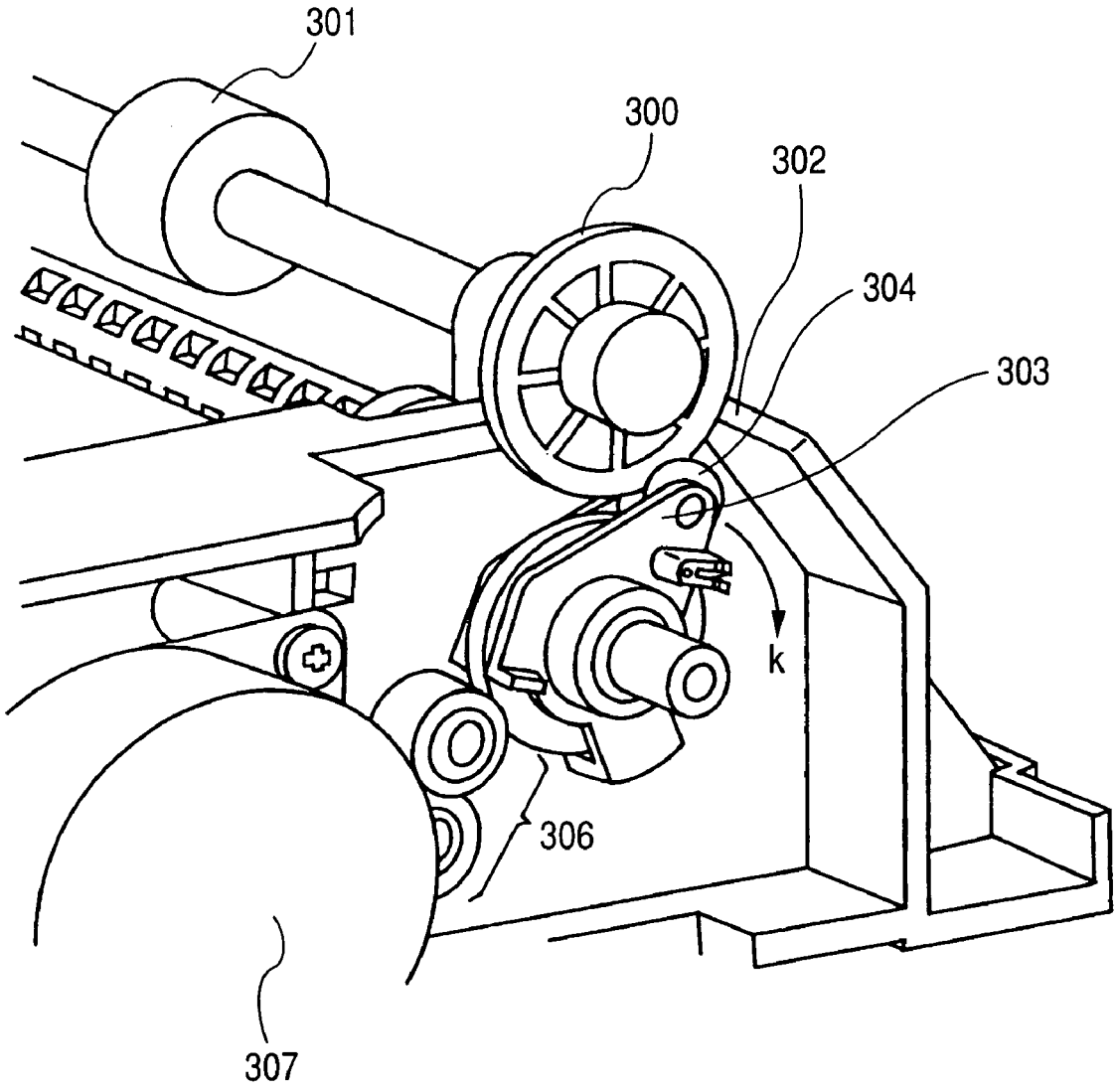
FIG. 20 is a perspective view showing a vicinity of a transfer roller in a second embodiment.
Figure 21:
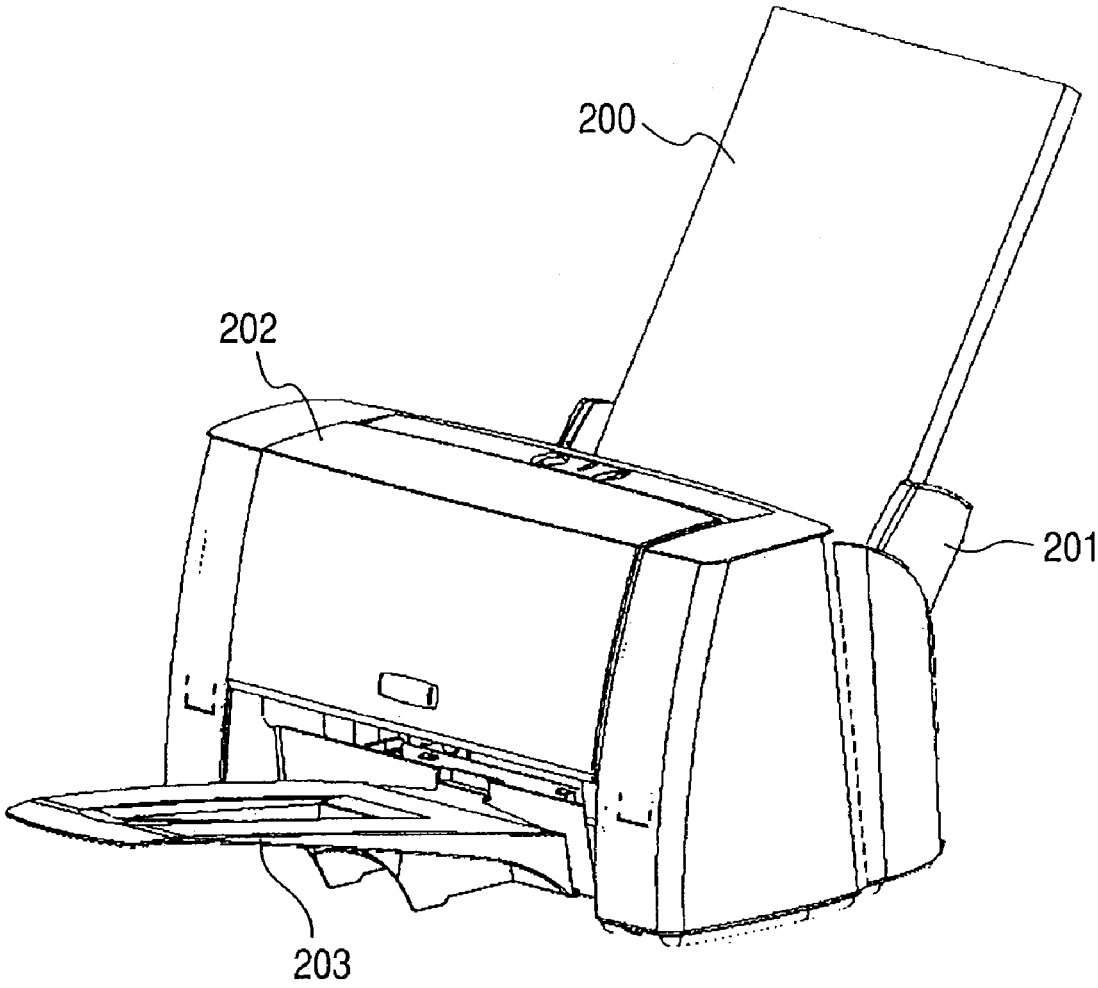
PRIOR ART FIG. 21
FIG. 21 is an external perspective view showing a prior ink jet recording apparatus.
Figure 22:
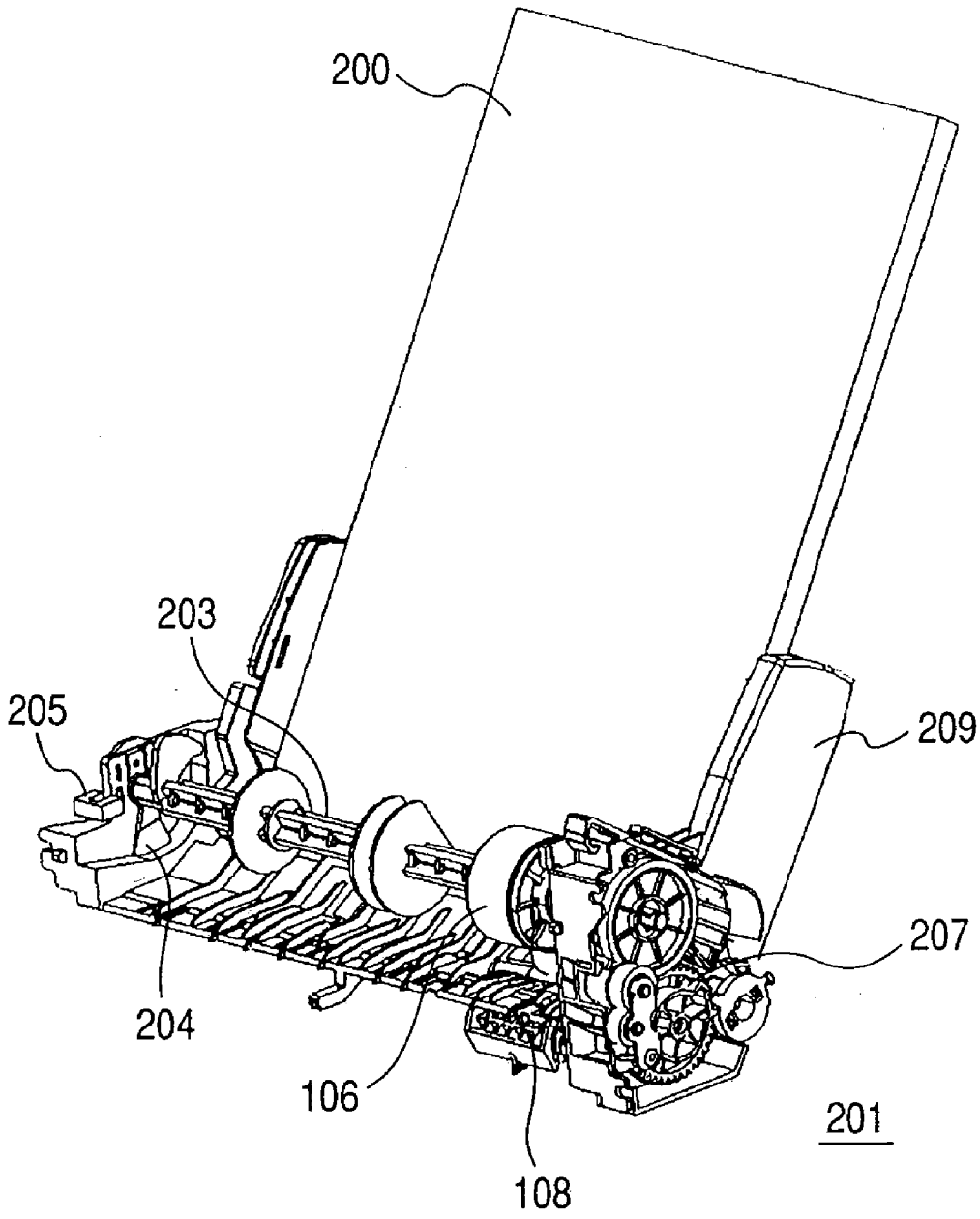
PRIOR ART FIG. 22
FIG. 22 is a perspective view showing a prior ASF.
Figure 23:
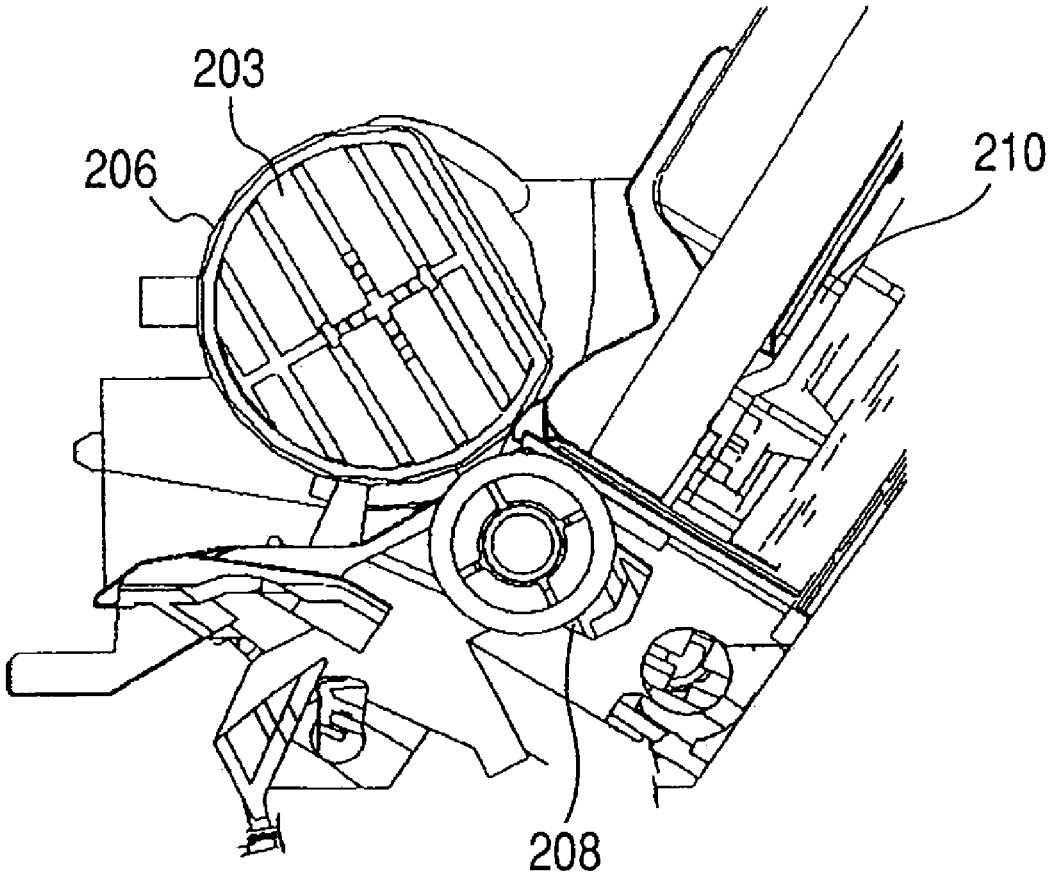
PRIOR ART FIG. 23
FIG. 23 is a cross-sectional view showing a prior feeding rubber portion.

FIG. 20 is a perspective view showing the vicinity of the transfer roller in the second embodiment. As shown in FIG. 20, a transfer roller 301 is fixed to a transfer roller gear 300 of a defined rotating direction. The transfer roller gear 300 is rotatably supported by a right-side chassis 302. The other end of the shaft supporting the transfer roller 301 is supported by a left-side chassis (not shown).

In the right-side chassis 302, there is also provided a pendulum gear unit (third drive transmission means) 303 for transmitting the driving power to the transfer roller gear 300. The transfer roller gear 300 meshes with a planet gear 304 of the pendulum gear unit 303. FIG. 19 shows a state where a stepping motor 307 is rotated in the forward direction to transmit the driving power from the pendulum gear unit 303 through an idler gear train 306 to the transfer roller gear 300 and a phase where the recording medium 41 is transferred to the LF roller 107 as in the first embodiment.

Figure 19:
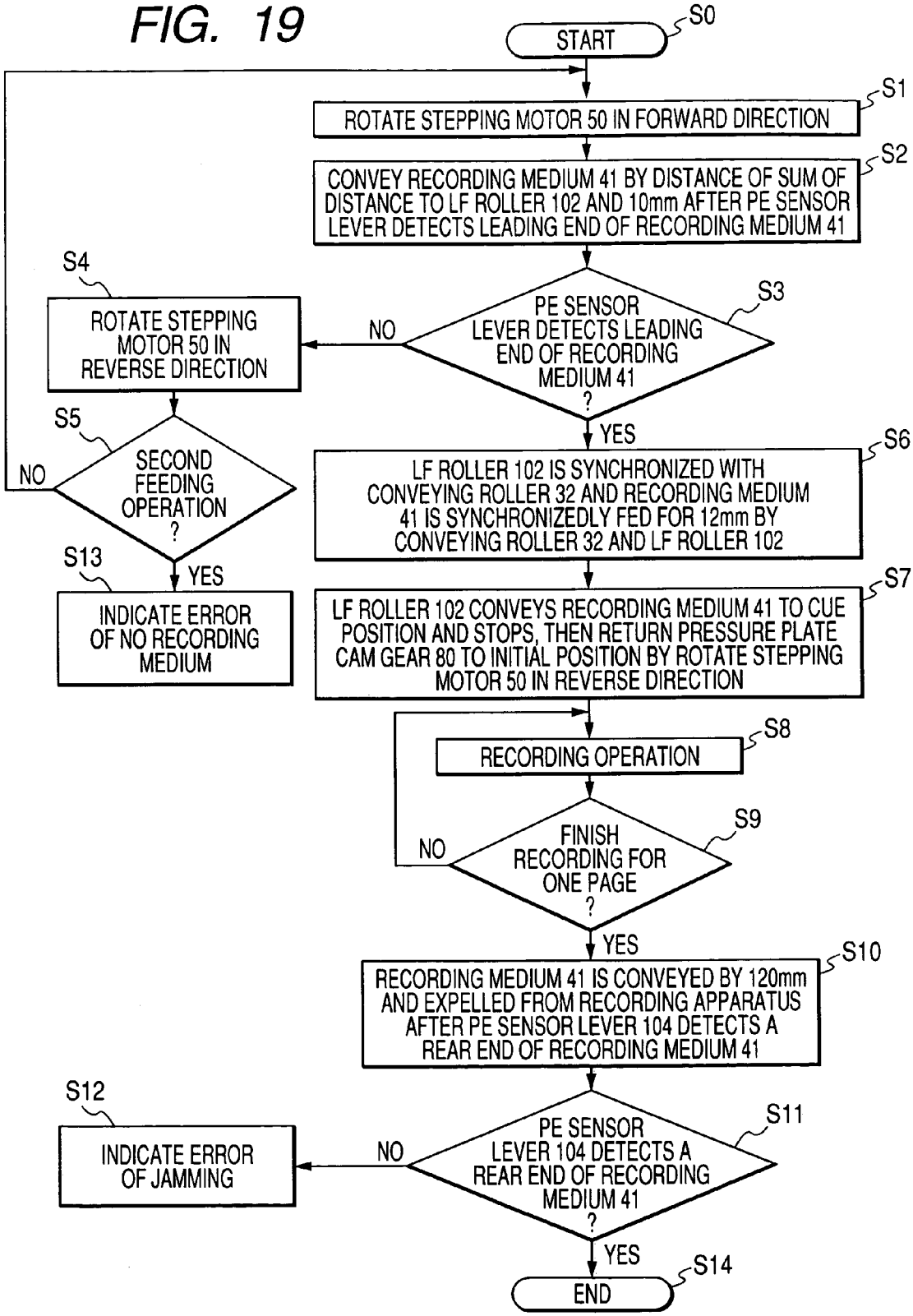
FIG. 19 is a flow chart showing a recording operation in the recording apparatus.

When the leading end of the recording medium 41 reaches the LF roller 107 and the stepping motor 307 is rotated in the reverse direction, the pendulum gear unit 202 is rocked in a direction k in FIG. 19 and is stopped by impinging on a stopper (not shown) provided on the right-side chassis 302. Thus a planet gear 304 is separated from the transfer roller gear 300 and is freed from the meshing state therewith, thereby reaching a power non-transmission state in which the driving power of the stepping motor 307 is not transmitted.

Therefore, during an intermittent conveying operation by the LF roller 107, the transfer roller 301 is driven by the LF roller 107. The transfer roller 301 can be driven satisfactorily, though an inertial load at such drive and a dynamic frictional load at the bearings in the left- and right-side chassis are added, since such additional loads are small.

Thus, in comparison with the first embodiment, the second embodiment allows to dispense with the rocking lever, the cam gear, the idler gear etc. for rocking the transfer roller thereby simplifying the entire configuration of the cassette feeding unit and the recording apparatus and reducing the production cost.

This application claims priority from Japanese Patent Application No. 2003-306413 filed Aug. 29, 2003, which is hereby incorporated by reference herein.

What is claimed is:

1. A feeding apparatus comprising:

a feeding roller for feeding a recording medium;

a pressure plate provided movably between a contact position pressed to the feeding roller and a separated position separated from the feeding roller;

pressure plate pressing means which provides the pressure plate with a pressing load for contacting the pressure plate with the feeding roller;

a motor for generating a driving power for moving the pressure plate to the contact position and to the separated position and a driving power for rotating the feeding roller;

first drive transmission means for transmitting a drive power of the motor to the pressure plate upon forward rotation of the motor and, after contacting and separating the pressure plate with and from the feeding roller, shifting the driving power to the pressure plate to a non-transmission state, and transmitting the drive power of the motor to the pressure plate upon reverse rotation of the motor, and after returning the pressure plate to a separated position, shifting the driving power to the pressure plate to the non-transmission state;

second drive transmission means which transmits the driving power from the motor to the feeding roller;

medium separation means which is provided at a downstream side of a contact position between the pressure plate and the feeding roller in a conveying direction of the recording medium and which separates the recording media one by one;

conveying means which is provided at a downstream side of the medium separation means, for conveying the recording medium; and control means which includes detection means for detecting arrival of a leading end of the recording medium at the conveying means and which reverses the motor after detection of the leading end of the recording medium by the detection means, wherein the pressure plate pressing means includes a spring for generating the pressing load, direction converting means which changes a direction of load substantially perpendicularly from a biasing direction of the spring to a contact direction of the pressure plate to the feeding roller, a first movable plate for moving the pressure plate, and a second movable plate for moving the first movable plate, and the first and second movable plates are positioned parallel to the pressure plate when the pressure plate is moved to the separated position.

2. A feeding apparatus according to claim 1, wherein the second drive transmission means transmits the driving power from the motor to the feeding roller through the first drive transmission means, and rotates and stops the feeding roller in synchronization with a transmission state and the non-transmission state of the driving power to the pressure plate.

3. A feeding apparatus according to claim 1, further comprising:

a transfer roller positioned at a downstream side of the medium separation means and at an upstream side of the conveying means and serving to convey the recording medium;

a pinch roller pressed to the transfer roller; and third drive transmission means which transmits a rotary driving power from the motor to the transfer roller.

4. A feeding apparatus according to claim 3, wherein the third drive transmission means rotates the transfer roller in a direction for transferring the recording medium toward the conveying means, regardless of whether the motor is rotated in the forward direction or in the reverse direction.

5. A feeding apparatus according to claim 3, wherein the third drive transmission means transmits the driving power from the motor to the transfer roller in the forward rotation of the motor, and attains a non-transmission state of interrupting the transmission of the driving power in the reverse rotation of the motor.

6. A feeding apparatus according to claim 3, further comprising:

contact/separation means which contacts the transfer roller and the pinch roller when the motor is rotated in the forward direction and separates the transfer roller and the pinch roller when the motor is rotated in the reverse direction.

7. A recording apparatus for recording by recording means on a recording medium fed by a feeding apparatus according to claim 1.

* * * * *